US007694657B2

(12) United States Patent
Gunji et al.

(10) Patent No.: US 7,694,657 B2
(45) Date of Patent: Apr. 13, 2010

(54) ENGINE FOR MOTORCYCLE

(75) Inventors: Toru Gunji, Saitama (JP); Hiroyuki Sugiura, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 1009 days.

(21) Appl. No.: 11/331,096

(22) Filed: Jan. 13, 2006

(65) Prior Publication Data

US 2006/0157004 A1 Jul. 20, 2006

(30) Foreign Application Priority Data

Jan. 18, 2005 (JP) ..... 2005-009825

(51) Int. Cl.
*F02B 75/32* (2006.01)
*F02B 75/22* (2006.01)

(52) U.S. Cl. ..... 123/54.4; 123/197.1; 123/198 C; 123/195 R; 123/196 R

(58) Field of Classification Search ..... 123/54.4, 123/197.1, 195 R, 195 H, 196 R, 198 C
See application file for complete search history.

(56) References Cited

U.S. PATENT DOCUMENTS 4,606,310 A * 8/1986 Makino ..... 123/192.2
4,633,826 A * 1/1987 Tominaga et al. ..... 123/90.31
4,637,354 A * 1/1987 Tominaga et al. ..... 123/54.4
5,078,105 A * 1/1992 Ito et al. ..... 123/195 R
5,740,773 A * 4/1998 Ohshige ..... 123/198 DA
6,637,398 B2 * 10/2003 Suzuki et al. ..... 123/195 R
6,666,183 B2 * 12/2003 Abe et al. ..... 123/195 R
6,715,376 B2 * 4/2004 Hojyo et al. ..... 74/414
6,962,096 B2 * 11/2005 Hojyo ..... 74/606 R
7,100,562 B2 * 9/2006 Terada et al. ..... 123/195 R
7,156,060 B2 * 1/2007 Oshita et al. ..... 123/90.31
7,261,079 B2 * 8/2007 Gunji et al. ..... 123/196 R
2004/0244761 A1 * 12/2004 Takeuchi ..... 123/196 R
2005/0039718 A1 * 2/2005 Tsutsumi et al. ..... 123/196 R

FOREIGN PATENT DOCUMENTS

JP 59-23032 A 2/1984

* cited by examiner

*Primary Examiner*—Michael Cuff
*Assistant Examiner*—Hung Q Nguyen
(74) *Attorney, Agent, or Firm*—Birch, Stewart, Kolasch & Birch, LLP

(57) ABSTRACT

In an engine for a motorcycle, a main shaft is supported rotatably by first and second support walls of a lower case which constitutes a part of a crank case. The center distance between the crank shaft and the main shaft is to be shortened while attaining a reduction in the number of parts and the number of assembling steps. A first bearing hole is formed in a first support wall for fitting therein and holding a first bearing which is mounted on one end of the main shaft. A second bearing hole is formed in a second support wall which permits the main shaft to be inserted therein from an opposite end side of the main shaft until one end of the main shaft is fitted in the first bearing. A second bearing is fitted and held in the second bearing hole so as to be fitted on the main shaft from the opposite end side of the main shaft after fitting of one end of the main shaft into the first bearing.

9 Claims, 14 Drawing Sheets

ENGINE FOR MOTORCYCLE

CROSS-REFERENCE TO RELATED APPLICATIONS

This nonprovisional application claims priority under 35 U.S.C. § 119(a) on Patent Application No. 2005-009825, filed in Japan on Jan. 18, 2005, the entirety of which is incorporated herein by reference.

BACKGROUND OF THE INVENTION

1. Field of the Invention

The present invention relates to an engine for a motorcycle wherein a crank shaft and a counter shaft parallel to the crank shaft are supported rotatably by a crank case. The crank case including an upper case and a lower case joined to each other, and a main shaft having an axis parallel to the crank shaft and the counter shaft is supported rotatably by first and second support walls, the first and second walls being provided in the lower case spaced along the axis of the main shaft.

2. Description of Background Art

For example in Japanese Patent Publication No. Hei 2-43886, there already is known an engine for a motorcycle wherein a crank shaft and a counter shaft parallel to the crank shaft are supported rotatably between an upper case and a lower case which are joined together so as to constitute a crank case. A main shaft is supported rotatably by the lower case at a position corresponding to between the crank shaft and the counter shaft in order to shorten the center distance between the crank shaft and the counter shaft.

In the above structure wherein the main shaft is supported rotatably in the lower case of the crank case at a portion of the lower case other than the surface joined with the upper case, it is difficult to form a bearing by a pair of half portions. Therefore, according to the structure disclosed in Japanese Patent Publication No. Hei 2-43886, a through hole larger in diameter than a main gear of a maximum diameter out of plural main gears, which are provided on the main shaft so as to constitute a part of gear trains of plural shift ranges, is formed in one of a pair of support walls which one wall is located on the side where the main shaft is inserted at the time of assembly. A bearing is interposed between the main shaft and a bearing holder which is fitted and fixed into the through hole.

In the above structure wherein the through hole for fitting and fixing therein the bearing holder is formed in a support wall, it is necessary for the through hole to have a relatively large diameter. Therefore, a limit is encountered in shortening the distance between the main shaft and a shaft other than the main shaft. In addition, auxiliary devices which require bearings, such as a shift drum and an oil pump, are disposed in the lower case, so that it is difficult to shorten the center distance between the crank shaft and the main shaft. Therefore, in the engine disclosed in Japanese Patent Publication No. Hei 2-43886, power from the crank shaft is transmitted to the main shaft side through a chain. In the structure using a bearing holder, the number of parts used increases and the main shaft assembly becomes troublesome.

SUMMARY OF THE INVENTION

The present invention has been accomplished in view of the above-mentioned circumstances and it is an object of the invention to provide an engine for a motorcycle able to shorten the center distance between a crank shaft and a main shaft while reducing the number of parts and the number of assembling steps.

For achieving the above-mentioned object, according to a first aspect of the present invention, there is provided an engine for a motorcycle wherein a crank shaft and a counter shaft parallel to the crank shaft are supported rotatably by a crank case. The crank case includes an upper case and a lower case joined to each other. A main shaft having an axis parallel to the crank shaft and the counter shaft is supported rotatably by first and second support walls. The first and second support walls are provided in the lower case spaced along the axis of the main shaft. A first bearing hole is formed in the first support wall. The first bearing is mounted on one end of the main shaft. A second bearing hole is formed in the second support wall. The second bearing hole permis the main shaft to be inserted therein from an opposite end side of the main shaft until one end of the main shaft is fitted in the first bearing fitted and held in the first bearing hole. A second bearing is fitted and held in the second bearing hole so as to be fitted on the main shaft from the opposite side of the main shaft after one end of the main shaft is fitted in the first bearing.

According to a second aspect of the present invention, auxiliary devices are disposed around the main shaft.

According to a third aspect of the present invention, an oil pump as one of the auxiliary devices is disposed between vertical planes passing respectively through the axes of the crank shaft and the main shaft so that the oil pump operates in an interlocked manner with the crank shaft or the main shaft.

According to a fourth aspect of the present invention, a first bank and a second bank disposed rearward from the first bank in a mounted state on the motorcycle are provided contiguously to the upper case of the crank case so as to mutually form a V-shape. Furthermore, a ceiling wall portion of the upper case covers the counter shaft from above and is provided contiguously to a rear portion of a cylinder block of the second bank at an approximately intermediate portion in the axial direction of a cylinder bore formed in a cylinder block of the second bank.

According to the first aspect of the present invention, a second bearing hole is formed in the second support wall. The second bearing hole permits the main shaft to be inserted therein from an opposite end side of the main shaft until one end of the main shaft is fitted and held in the first bearing hole. A second bearing is fitted and held in the second bearing hole so as to be fitted on the main shaft from the opposite side of the main shaft after one end of the main shaft is fitted in the first bearing. Therefore, the second bearing hole can be made smaller in diameter than the through hole heretofore formed, so that it is possible to shorten the center distance between the crank shaft and the main shaft and hence possible to reduce the size of the engine in the longitudinal direction of the motorcycle. In addition, the bearing holder which has heretofore been required becomes unnecessary. Therefore, it becomes possible to decrease the number of parts. Additionally, it is possible to decrease the number of assembling steps because the bearing holder assembly is not needed.

According to the second aspect of the present invention, it is possible to shorten the distance between the main shaft and the auxiliary devices disposed around the main shaft and hence possible to further reduce the size of the engine.

According to the third aspect of the present invention, it is possible to disposed an oil pump by utilizing a space created between the crank shaft and the main shaft. In addition, a power transfer mechanism for the transfer of power between the crank shaft or the main shaft and the oil pump can be made compact by disposing it in proximity to the crank shaft or the main shaft which drives the oil pump.

According to the fourth aspect of the present invention, the counter shaft can be disposed close to the cylinder block in the second bank, whereby the size of the engine can be further reduced in the longitudinal direction of the motorcycle.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The present invention will be described hereinunder by way of an embodiment thereof illustrated in the accompanying drawings.

Figure 1:
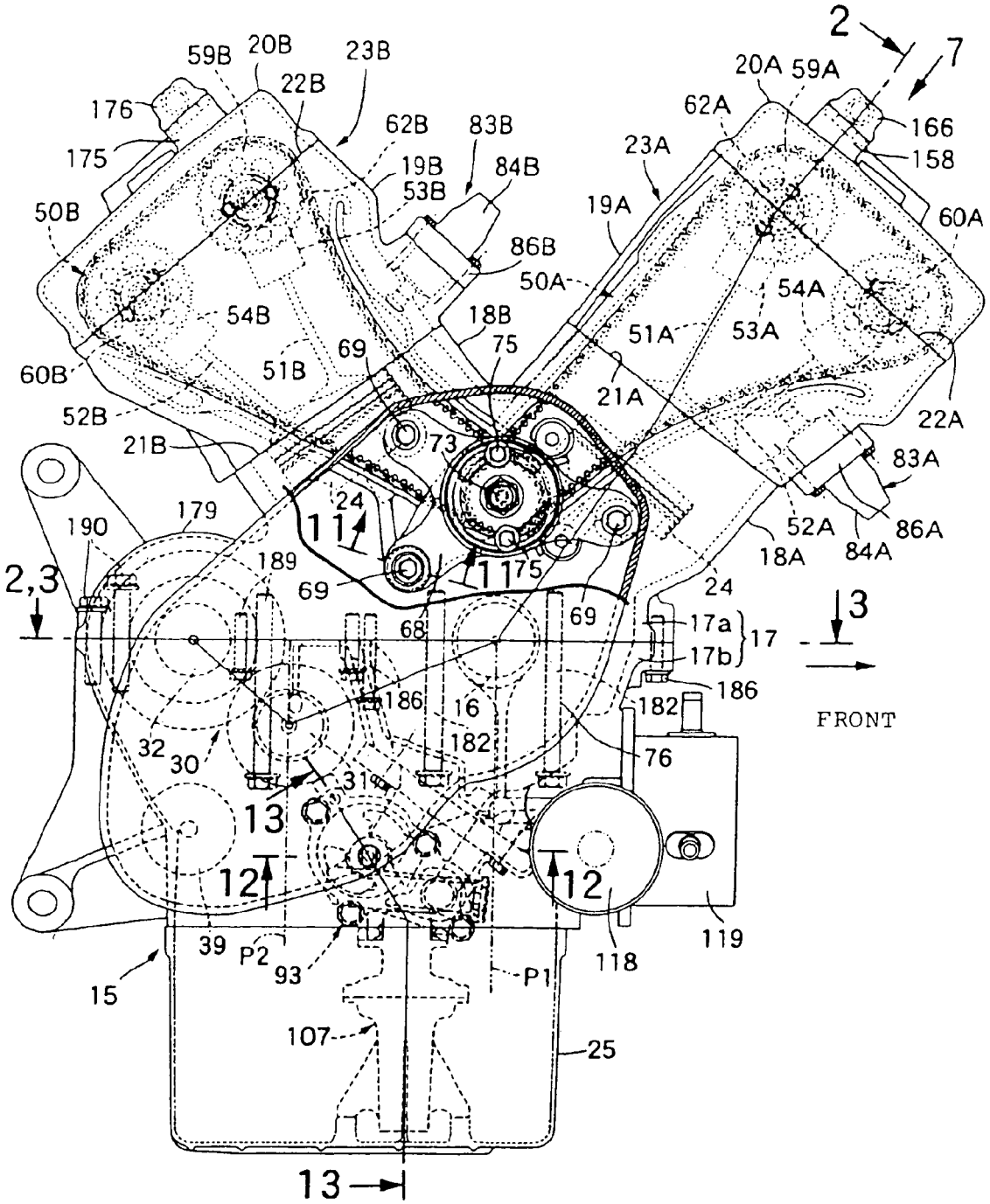
FIG. 1 is a partially cut-away side view of a V-type engine.

First, in FIG. 1, for example a five-cylinder V-type engine is mounted on a motorcycle. An engine body 15 of the engine includes a crank case 17 which supports a crank shaft 16 rotatably. The crank shaft 16 has an axis extending in the transverse direction of the motorcycle. A first cylinder block 18A is joined to the crank case 17 on a front side in an advancing direction of the motorcycle. A first cylinder head 19A is joined to an upper-end joining surface 21A of the first cylinder block 18A. A first head cover 20A is joined to an upper-end joining surface 22A of the first cylinder head 19A. A second cylinder block 18B is joined to the crank case 17 on a rear side in the advancing direction of the motorcycle. A second cylinder head 19B is joined to an upper-end joining surface 21B of the second cylinder block 18B. A second head cover 20B is joined to an upper-end joining surface 22B of the second cylinder head 19B.

The crank case 17 includes an upper case 17*a* and a lower case 17*b* joined to each other. The crank shaft 16 is supported rotatably between the upper case 17*a* and the lower case 17*b*. In addition, the first and second cylinder blocks 18A, 18B are formed integrally with the upper case 17*a*.

A first bank 23A of three cylinders is contiguous to the crank case 17 in a state in which it is inclined forwardly upward toward the front side in the advancing direction of the motorcycle. The first bank 23A is composed of the first cylinder block 18A, the first cylinder head 19A and the first head cover 20A. A second bank 23B of two cylinders is contiguous to the crank case 17 on the rear side of the first bank 23A so as to form an upwardly open V shape together with the first bank 23A. The second bank 23B is composed of the second cylinder block 18B, the second cylinder head 19B and the second head cover 20B.

Figure 2:
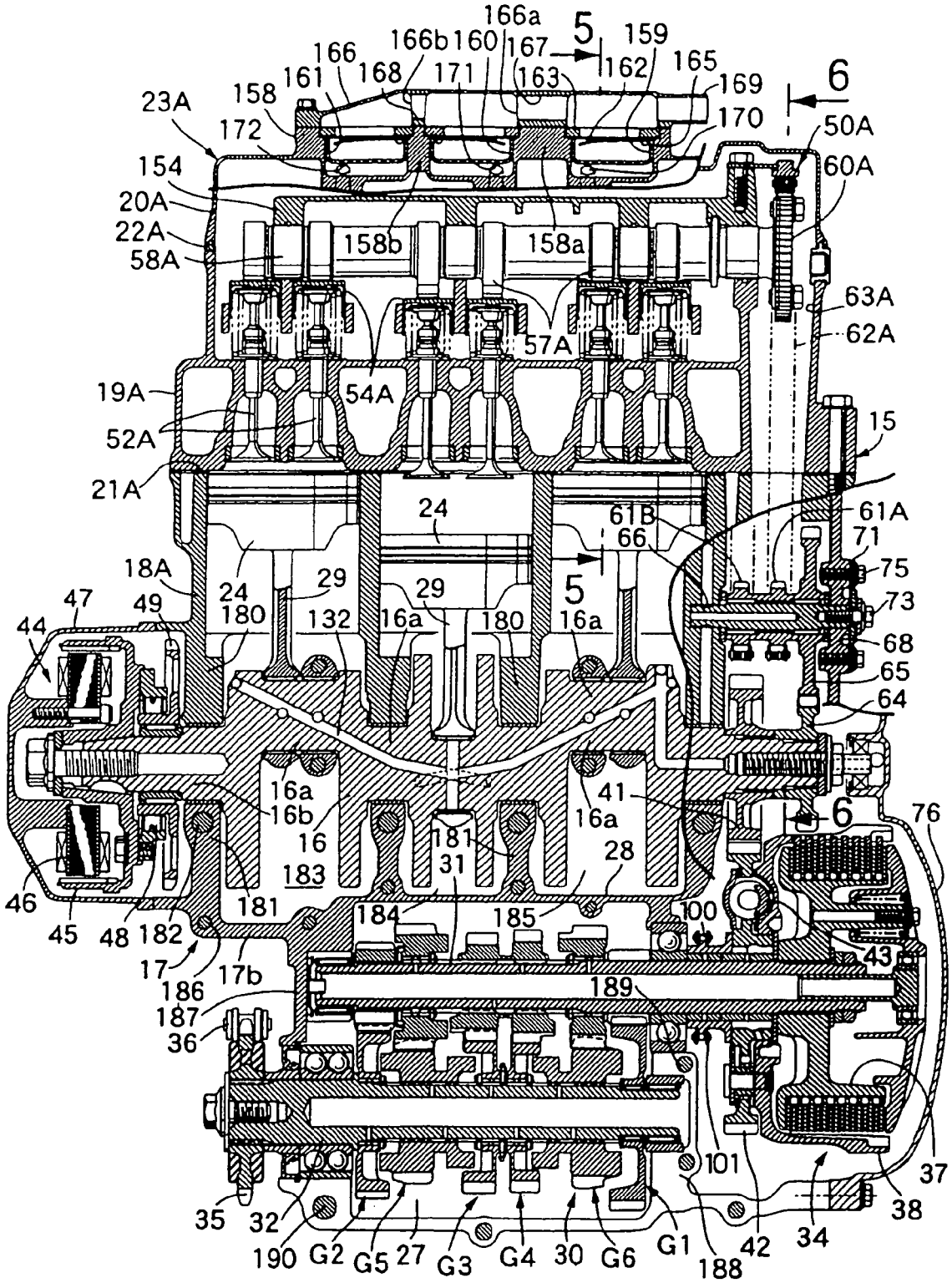
FIG. 2 is a sectional view taken on line 2-2 in FIG. 1.

Referring also to FIG. 2, three pistons 24 arranged axially of the crank shaft 16 are slidably fitted into the first cylinder block 18A of the first bank 23A, while two pistons 24 arranged axially of the crank shaft 16 are slidably fitted into the second cylinder block 181B of the second bank 23B. The pistons 24 in both banks 23A and 23B are connected in common to crank pins 16*a* of the crank shaft 16 through connecting rods 29.

Figure 3:
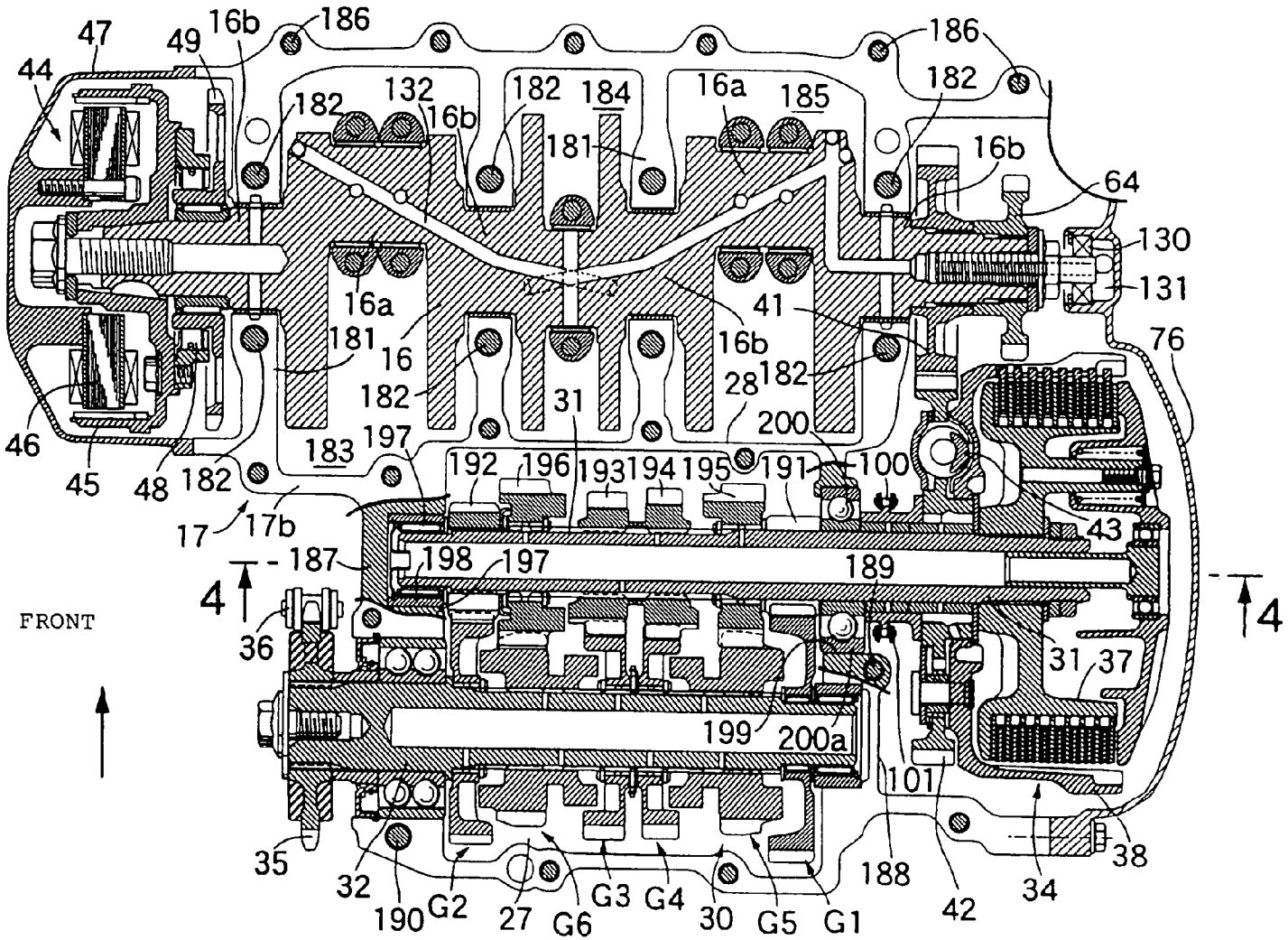
FIG. 3 is a sectional view taken on line 3-3 in FIG. 1.

Referring also to FIG. 3, four upper journal walls 180, which are arranged spaced in the axial direction of the crank shaft 16, are formed integrally with the upper case 17*a*, and four lower journal walls 181 corresponding respectively to the upper journal walls 180 are formed integrally with the lower case 17*b*. Four journal portions 16*b* of the crank shaft 16 are supported rotatably between the upper journal walls 180 and the lower journal walls 181. The upper journal walls 180 and the lower journal walls 181 are joined to each other by plural pairs of connecting bolts 182, each pair being disposed on both sides of each journal portion 16*b*. The connecting bolts 182 are inserted through the lower case member 17*b* from below and are brought into threaded engagement with the upper case member 17*a*.

As a result of the upper journal walls 180 and the lower journal walls 181 being mutually joined a first crank chamber 183, a second crank chamber 184 and a third crank chamber 185 are formed within the crank case 17. The first crank chamber 183 corresponds to the cylinders located at one end (the left end in a state facing the front side in the motorcycle advancing direction) in the arranged direction of the cylinders in the first and second banks 23A, 23B. The second crank chamber 184 corresponds to the center cylinder in the arranged direction of the cylinders in the first bank 23A. The third crank chamber 185 corresponds to the cylinders located at an opposite end (the right end in a state facing the front side in the motorcycle advancing direction) in the arranged direction of the cylinders in the first and second banks 23A, 23B. The pistons 24 of the cylinders at one end in the arranged direction of the cylinders in the first and second banks 23A, 23B are connected through connecting rods 29 to the crank pin 16*a* disposed in the first crank chamber 183. The piston 24 of the central cylinder in the arranged direction of the cylinders in the first bank 23A is connected through a connecting rod 29 to the crank pin 16*a* disposed in the second crank chambers 184. The pistons 24 of the cylinders at the opposite end in the arranged direction of the cylinders in the first and second banks 23A, 23B are connected through connecting rods 29 to the crank pin 16*a* disposed in the third crank chamber 185.

The upper and lower cases 17*a*, 17*b* are joined together using plural connecting bolts 186 which are arranged around the first to third crank chambers 183 to 185. The connecting bolts 186 have respective lengths depending on the positions where they are disposed. The connecting bolts 186 are inserted through the lower case 17*b* from below and are brought into threaded engagement with the upper case 17*a*.

An oil pan 25 is joined to a lower portion of the crank case 17, i.e., a lower portion of the lower case 17*b*. A barrier rib 28 and a transmission chamber 27 are provided in the crank case 17. The barrier rib 28 partitions between the first to third crank chambers 183 to 185 and the transmission chamber 27 is formed by both the rank case 17 and the oil pan 25 so as to be positioned on the rear and lower sides of the crank chambers 183 to 185.

A constant mesh type gear transmission 30 is accommodated within the transmission chamber 27 on the rear side of the first to third crank chambers 183 to 185. The gear transmission 30 includes plural shift ranges, e.g., six shift ranges from first to sixth shift gear trains G1 to G6, capable of being engaged selectively. The gear trains G1 to G6 are disposed between a main shaft 31 and a counter shaft 32 both having axes parallel to the crank shaft 16. The counter shaft 32 is disposed on the rear side with respect to the crank shaft 16 so as to be supported rotatably between joining surfaces of the upper and lower cases 17*a*, 17*b* which constitute the crank case 17. The main shaft 31 is supported rotatably by the lower case 17*b* of the crank case 17 at a portion corresponding to between the crank shaft 16 and the counter shaft 32. Power from the crank shaft 16 is inputted to the main shaft 31 through a clutch 34.

The lower case 17*b* is provided with a left support wall 187 (as a first support wall) positioned on the left side in a state facing the front side in the motorcycle advancing direction and a right support wall 188 (as a second support wall) positioned on the right side in a state facing the front side in the motorcycle advancing direction. The left and right support walls 187, 188 are formed so as to delimit both ends of the transmission chamber 27 in the axial direction of the main shaft 31 and counter shaft 32. The upper case 17*a* is also provided with support walls corresponding respectively to the left and right support walls 187, 188 of the lower case 17*b*. One end side of the counter shaft 32 extends rotatably through the left support walls 187 of the crank case 17 and projects sideways outward.

An opposite end portion of the counter shaft 32 is supported rotatably by the right support walls 188 of the crank case 17. Moreover, a driving sprocket 35 is fixed to the end portion of the counter shaft 32 projecting from the left support walls 187 of the crank case 17. An endless chain 36 for transmitting power to a rear wheel (not shown) is entrained on the driving sprocket 35.

The upper and lower cases 17*a*, 17*b* are joined together using plural connecting bolts 189 and plural connecting bolts 190 which are arranged around the transmission chamber 27. Suitable lengths of the connecting bolts 189 and 190 are set according to respective positions. The connecting bolts 189, which are positioned on the crank shaft 16 side rather than the counter shaft 32 side, are inserted through the lower case 17*b* from below, unless bolt tightening can be performed from the overlying second bank 23B side, and are brought into threaded engagement with the upper case 17*a*. On the other hand, the connecting bolts 190, which are disposed on the side opposite to the crank shaft 16 with respect to the counter shaft 32, are inserted through the upper case 17A from above and are brought into threaded engagement with the lower case 17*b* because bolt tightening can be done easily from above.

As shown in FIG. 1, the upper case 17*a* is formed with an arcuate ceiling wall portion 179 which expands upward so as to cover the counter shaft 32 from above. The ceiling wall portion 179 is integrally connected to the cylinder block 18B of the second bank 23B at an approximately intermediate portion in the slide range of the piston 24.

A main gear 191 as a low gear which constitutes a part of the first shift gear train G1 is provided integrally on the main shaft 31. Also, second to sixth shift main gears 192 to 196 which constitute a part of the second to sixth shift gear trains G2 to G6 are mounted on the main shaft 31 in a relatively unrotatable manner. The first to sixth shift main gears 191 to 196 are arranged successively side by side from one end side of the main shaft 31 in order of second shift main gear 192, sixth shift main gear 196, third shift main gear 193, fourth shift main gear 194, fifth shift main gear 195, and first shift main gear 191.

One end of the main shaft 31 is supported rotatably by the left support wall 187 in the lower case 17 through a needle bearing 197 (as a first bearing). A bottomed, first bearing hole 198 for fitting therein of an outer race 197*a* of the needle bearing 197 is formed in an inner surface of the left support wall 187. On the other hand, the main shaft 31 extends rotatably through the right support wall 188 in the lower case 17*b*. A second bearing hole 199 is formed in the right support wall 188 so as to permit passing therethrough of an intermediate portion of the main shaft 31. A ball bearing 200 (as a second bearing) is interposed between the inner periphery of the second bearing hole 199 and the outer periphery of the main shaft 31.

The outside diameter of an outer race 200*a* of the ball bearing 200, i.e., the inside diameter of the second bearing hole 199, is set smaller than the diameter of the sixth shift main gear 196. The sixth shift main gear 196 is the largest in diameter among the first to sixth shift main gears 191 to 196 mounted in a relatively unrotatable manner on the main shaft 31. In this embodiment, the diameter of the sixth shift main gear 196 is set smaller than the diameter of the fifth shift main gear 195.

Figure 4A:
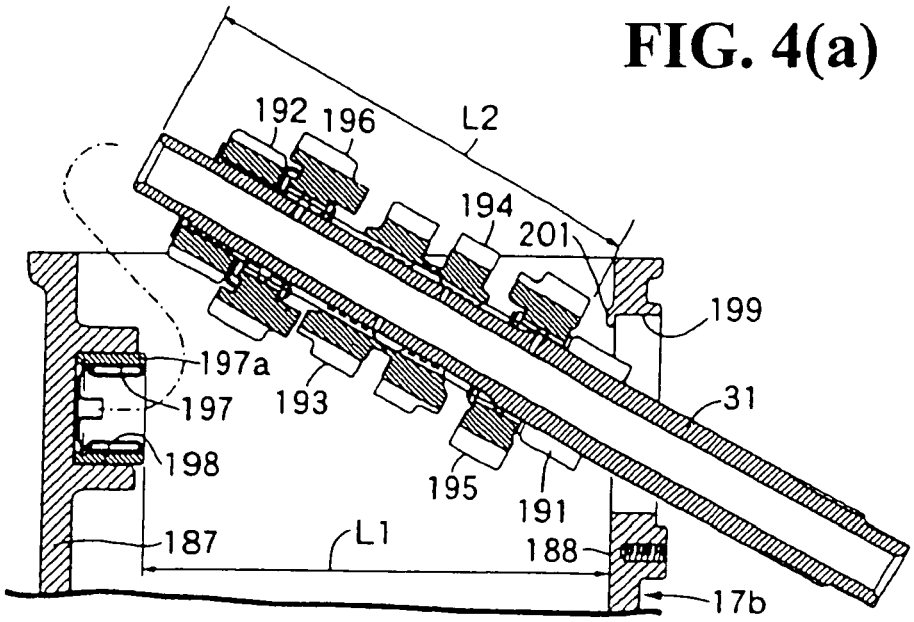
FIG. 4 is a sectional view for explaining a procedure for mounting a main shaft to a lower case.
Figure 4B:
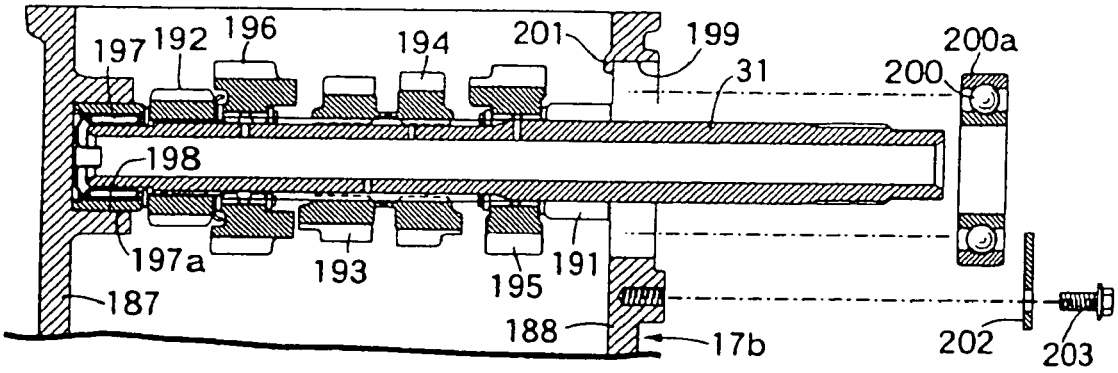
Figure 4C:
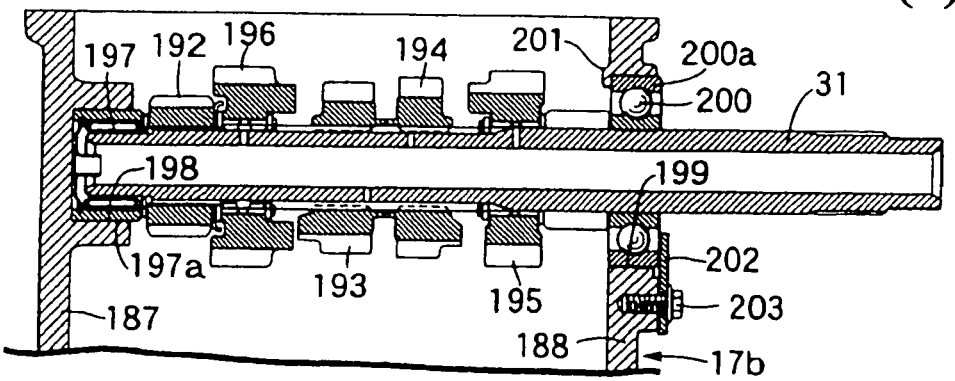

In mounting the main shaft 31 to the lower case 17*b*, first as shown in FIG. 4(*a*), the outer race 197*a* of the needle bearing 197 is fitted and held in the first bearing hole 198 of the left support wall 187. At the same time the main shaft 31 with the first to sixth shift main gears 191 to 196 formed thereon is inserted into the second bearing hole 199 from the opposite end side of the main shaft 31. At this time, it is necessary that the first shift main gear 191 integral with the main shaft 31 be inserted into the second bearing hole 199, and the inside diameter of the second bearing hole 199 is set at a value sufficient to permit insertion therein of the first shift main gear 191. Furthermore, in order that one end of the main shaft 31 can be fitted in the needle bearing 197 fitted and held in the first bearing hole 198 in a state in which the first shift main gear 191 is inserted into the second bearing hole 199, the length L2 between one end of the main shaft 31 and a side end portion of the first shift gear 191 of the fifth shift main gear 195 is set shorter than the length L1 between inner ends of the needle bearing 198 and the second bearing hole 199.

Next, as shown in FIG. 4(*b*), a state in which an intermediate portion of the main shaft 31 is fitted at one end thereof in the needle bearing 197 and extends through the second bearing hole 199 is illustrated. In this state, the ball bearing 200 is fitted onto the main shaft 31 from the opposite end side of the main shaft and the outer race 200*a* of the ball bearing 200 is fitted in the second bearing hole 199 from the outside, as shown in FIG. 4(*c*).

A projection 201 projecting inwards from an inner end of the second bearing hole 199 and receiving one end of the outer race 200*a* is formed integrally on an inner surface of the right support wall 188. Moreover, a support plate 202 abutted against an outer end of the outer race 200*a* is clamped to an outer surface of the right support wall 188 with use of a screw member 203. The ball bearing 200 is interposed between the outer periphery of the main shaft 31 and the inner periphery of the second bearing hole 199 so that the axial movement of the ball bearing 200 is restricted by the projection 201 and the support plate 202.

Referring now to FIGS. 2 and 3, one end portion of the crank shaft 16 projects from the upper and lower journal walls 180 and 181 positioned at the left end in a state facing the front side in the motorcycle advancing direction out of the upper and lower journal walls 180, 181 of the crank case 17. An outer rotor 45 of a generator 44 is fixed to the opposite end portion of the crank shaft 16. Moreover, an inner stator 46 which constitutes the generator 44 together with the outer rotor 45 is fixed to a generator cover 47 which is joined to the left support wall of the crank case 17 so as to cover the generator 44. Furthermore, a gear 49 is connected to the outer rotor 45 through a one-way clutch 48 and it is interlocked with a starting motor (not shown).

The opposite end portion of the crank shaft 16 projects from the upper and lower journal walls 180, 181 positioned at the right end in a state facing the front side in the motorcycle advancing direction out of the upper and lower journal walls 180, 181 of the crank case 17. A primary driving gear 41 of a relatively large diameter is fixed to the opposite end portion of the crank shaft 16 outside the crank case 17 and a primary driven gear 42 meshing with the primary driving gear 41 is connected to an outer clutch 38 of the clutch 34 through a damper spring 43. The clutch 34 is a conventional multiple disc clutch having an inner clutch 37 incapable of relation rotation with respect to the main shaft 31 and the outer clutch 38 capable of relative rotation with respect to the main clutch 31.

Figure 5:
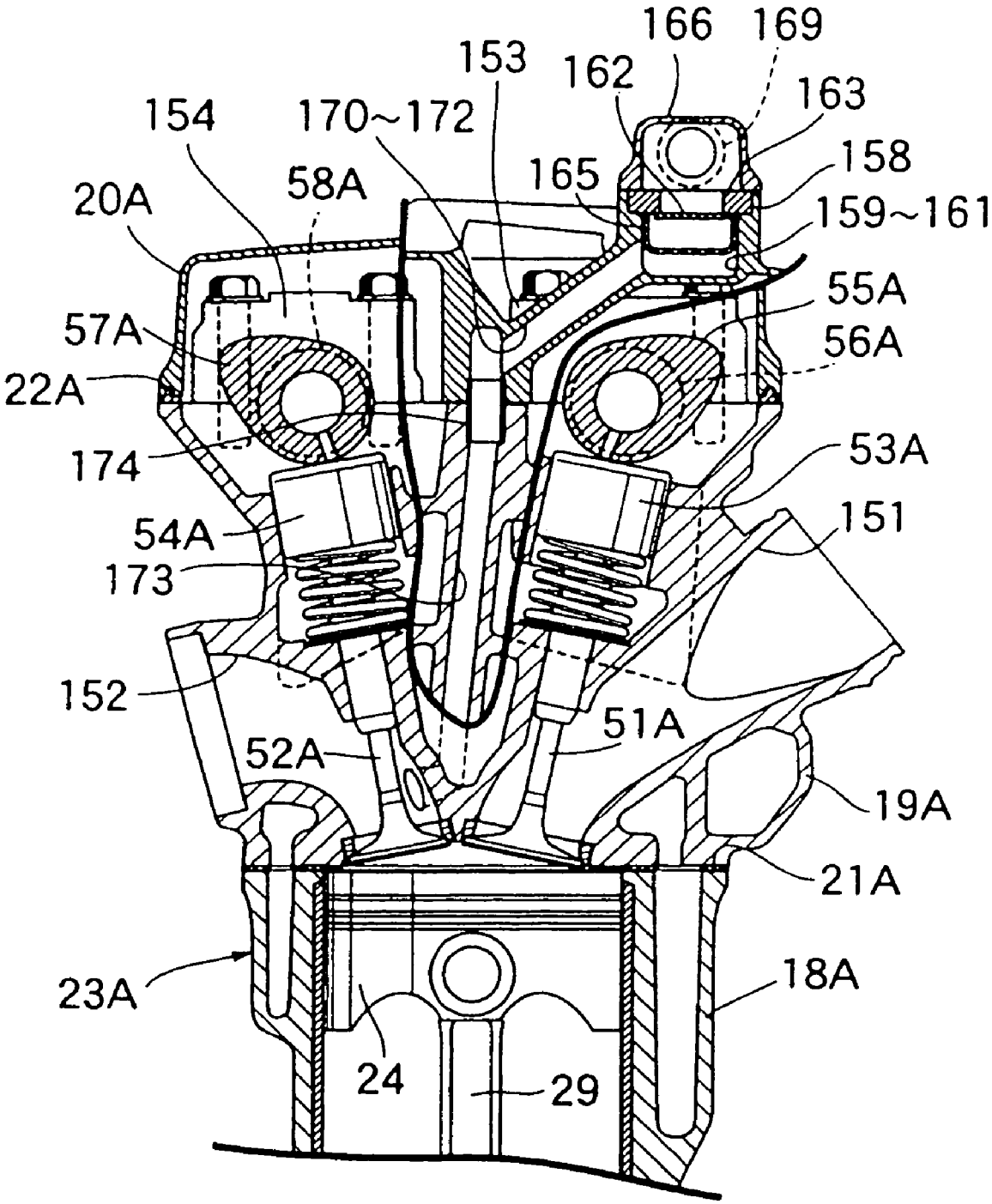
FIG. 5 is a sectional view taken on line 5-5 in FIG. 2.

In the first cylinder head 19A of the first bank 23A, as shown in FIG. 5, intake ports 151 which are open inwards of both banks 23A and 23B and exhaust ports 152 which are open to side walls opposite to the intake ports 151 are provided for each cylinder. A pair of intake valves 51A and a pair of exhaust valves 52A are disposed in the first cylinder head 19A respectively for the intake ports 151 and the exhaust ports 152 in such a manner that they can be opened and closed while being biased in a valve closing direction by means of springs. Moreover, bottomed cylindrical intake valve-side lifters 53A having closed end inner surfaces abutted respectively against the tops of the intake valves 51A and bottomed cylindrical exhaust valve-side lifters 54A having closed end inner surfaces abutted respectively against the tops of the exhaust valves 52A are fitted in the first cylinder head 19A so that they can slide in opening and closing directions of the intake valves 51A and the exhaust valves 52A.

An intake-side cam shaft 56A having plural intake-side cams 55A which are in sliding contact with closed end outer surfaces of the intake valve-side lifters 53A is supported rotatably about an axis parallel to the crank shaft 16 by means of the first cylinder head 19A and an intake-side cam holder 153 clamped to the first cylinder head 19A. Likewise, an exhaust-side cam shaft 58A having plural exhaust-side cams 57A which are in sliding contact with closed end outer surfaces of the exhaust valve-side lifters 54A is supported rotatably about an axis parallel to the crank shaft 16 by means of the first cylinder head 19A and an exhaust-side cam holder 154 clamped to the first cylinder head 19A.

Figure 6:
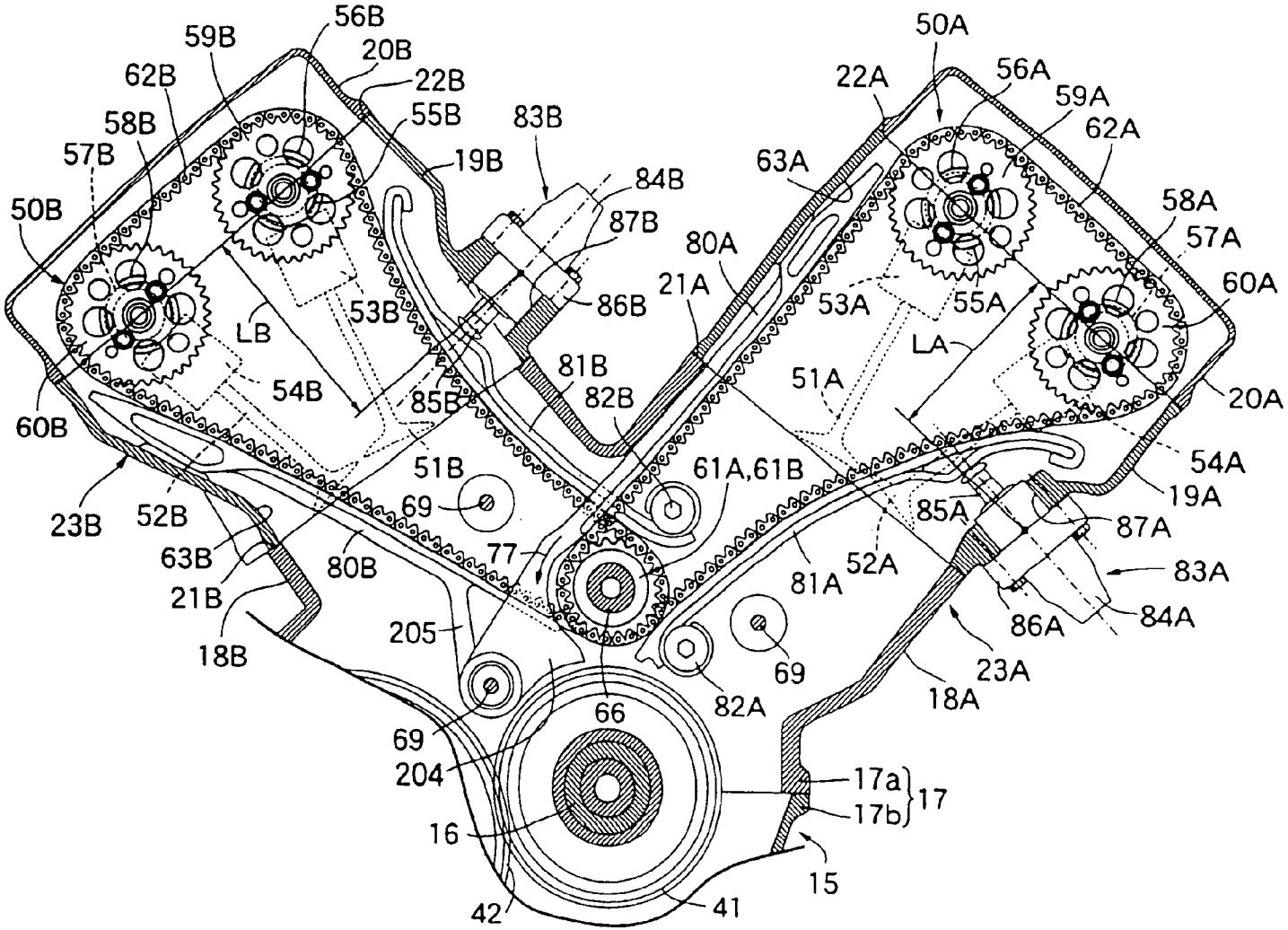
FIG. 6 is a sectional view taken on line 6-6 in FIG. 2.

Referring also to FIG. 6, intake valves 51B and exhaust valves 52B each in a pair are disposed for each cylinder in the second cylinder head 19B of the second bank 23B so that they can be opened and closed while being biased in a valve closing direction by means of springs. Intake-side cams 55B on an intake-side cam shaft 56B which is rotatable about an axis parallel to the crank shaft 16 are put in sliding contact with intake valve-side lifters 53B abutted against the tops of the intake valves 51B. Likewise, exhaust-side cams 57B on an exhaust-side cam shaft 58B which is rotatable about an axis parallel to the crank shaft 16 are put in sliding contact with exhaust valve-side lifters 54B abutted against the tops of exhaust valves 52B.

Figure 7:
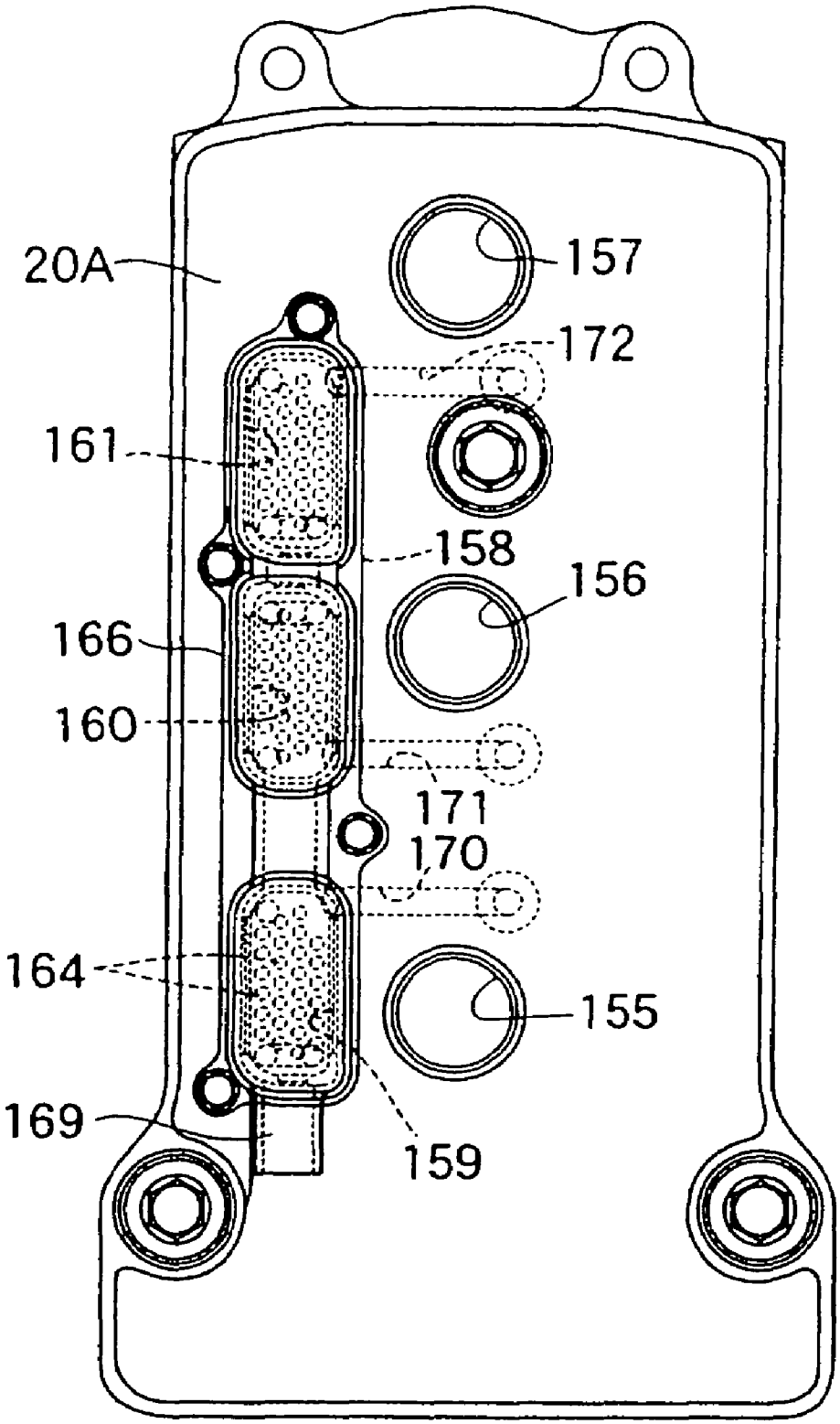
FIG. 7 is a view as seen in the direction of arrow 7 in FIG. 1.

In FIG. 7, three plug insertion holes 155, 156 and 157 for insertion therein of spark plugs (not shown) at positions corresponding to the centers of the cylinders are formed in the first head cover 20A of the first bank 23A at equal intervals in order from right to left in a state facing the front side in the motorcycle advancing direction. Furthermore, a mounting cylindrical portion 158 having a long cross sectional shape in the arranged direction of the plug insertion holes 155 to 157 projects from an upper surface of the first head cover 20A and on rearward from the plug insertion holes 155 to 157. Within the mounting cylindrical portion 158 are formed three mounting recesses 159, 160 and 161 in order from the right side in a state facing the front side in the motorcycle advancing direction. The mounting recesses 159, 160 and 161 are formed in such a manner that barrier ribs 158*a* and 158*b* having upper surfaces flush with an upper surface of a side wall of the mounting cylindrical portion 156 are formed between adjacent such recesses.

The mounting recesses 159 and 160 out of the mounting recesses 159 to 161 are formed at positions substantially corresponding to the plug insertion holes 155 and 156, while the mounting recess 161 is disposed at a position substantially corresponding to an intermediate portion between the plug insertion holes 156 and 157. That is, the distance between the mounting recess 160 which lies at an intermediate position of the mounting recesses 159 to 161 and the mounting recess 159 positioned on the right of the mounting recess 160 is set larger than the distance between the mounting recess 160 which lies in the intermediate position of the mounting recesses 159 to 161 and the mounting recess 161 positioned on the left side of the mounting recess 160. The mounting recesses 160 and 161 are positioned in proximity to each other.

A ring-like support member 163 with a reed valve 162 attached thereto is press-fitted in each of the mounting recesses 159 to 161 and a bottomed cylindrical protecting member 165 having plural small holes 164 (see FIG. 4) is press-fitted in each of the mounting recesses 159 to 161 so as to be positioned inside with respect to the reed valve 162.

A cap 166 is clamped to the mounting cylindrical portion 158 so as to cover the mounting cylindrical portion 158 from above. As shown in FIG. 2, the cap 166 is provided with barrier ribs 166*a* and 166*b* which are put in abutment against the barrier ribs 158*a* and 158*b* of the mounting cylindrical portion 158 from above. Coaxial communication holes 167 and 168 are formed in the barrier ribs 166*a* and 166*b*. Furthermore, a connecting cylindrical portion 169 extending coaxially with the communication holes 167 and 168 integrally project from the cap 166. A conduit (not shown) for the introduction of secondary air is connected to the connecting cylindrical portion 169. That is, secondary air is introduced between the cap 166 and the mounting cylindrical portion 158.

Secondary air passages 170, 171 and 172 are formed in the first head cover 20A so as to be open to inner surfaces of closed ends of the mounting recesses 159 to 161. The second air passages 170 and 171 are positioned between the plug insertion holes 155 and 156, while the secondary air passage 172 is positioned between the plug insertion holes 156 and 157.

On the other hand, as shown in FIG. 5, secondary air passages 173 that extend upward are formed in the first cylinder head 19A in such a manner that their lower ends are open to the exhaust ports 152 in the cylinders. Upper ends of the secondary air passages 173 communicate respectively with the secondary air passages 173 in the first head cover 20A through connecting pipes 174 which are held grippingly between the first head cover 20A and the first cylinder head 19A so as to serve also as positioning pins.

According to this secondary air supply structure on the first bank 23A side, the connecting cylindrical portion 158 provided on the first head cover 20A and the cap 166 attached to the connecting cylindrical portion 158 can be made compact.

In the second bank 23B, as shown in FIG. 1, a connecting cylindrical portion 175 projects on the second head cover 20B to supply secondary air to two cylinders located on the second bank 23B side. A cap 176 is attached to the connecting cylindrical portion 175. Although the shape of the connecting cylindrical portion 175 and that of the cap 176 are different from those of the connecting cylindrical portion 168 and the cap 166 located on the first bank 23A side, a reed valve disposing structure and a passage structure for conducting secondary air from the reed valves to the exhaust ports are the same as those on the first bank 23A side.

Referring again to FIG. 6, the rotating power of the crank shaft 16 is transmitted through power transfer section 50A to intake-side and exhaust-side cam shafts 56A, 58A in the first bank 23A. Likewise, the rotating power of the crank shaft 16 is transmitted through power transfer section 50B to the intake-side and exhaust-side cam shafts 56B, 58B in the second bank 23B.

The power transfer section 50A disposed on the first bank 23A includes intake-side and exhaust-side driven sprockets 59A, 60A which are fixed respectively to one ends of the intake-side and exhaust-side cam shafts 56A, 58A, a driving sprocket 61A for the first bank which sprocket is interlocked with rotation of the crank shaft 16, an endless cam chain 62A entrained on the driving sprocket 61A for the first bank and also on the intake-side and exhaust-side driven sprockets 59A, 60A, and a chain guide member 80A which is in contact with the outer periphery on the tension side of the cam chain 62A. The power transfer section 50A further includes a chain tensioner 81A which is in contact with the outer periphery on the slack side of the cam chain 62A, and a tensioner lifter 83A which is brought into abutment against the chain tensioner 81A from the side opposite to the cam chain 62A. The power transfer section 50B disposed on the second bank 23B includes intake-side and exhaust-side driven sprockets 59B, 60B which are fixed respectively to one ends of the intake-side and exhaust-side cam shafts 56B, 58B, a driving sprocket 61B for the second bank which sprocket is interlocked with rotation of the crank shaft 16, and an endless cam chain 62B entrained on the driving sprocket 61B for the second bank and also on the intake- and exhaust-side driven sprockets 59B, 60B. The power transfer section 50B includes a chain guide member 80B which is in contact with the outer periphery on the tension side of the cam chain 62B, a chain tensioner 81B which is in contact with the outer periphery on the slack side of the cam chain 62*b*, and a tensioner lifter 83B which is brought into abutment against the chain tensioner 81*b* from the side opposite to the cam chain 62B.

The driving sprocket 61A for the first bank and the driving sprocket 61B for the second bank, which are each adapted to rotate about an axis parallel to the crank shaft 16, are disposed outside the right support wall in the crank case 17 and above the opposite end portion of the crank shaft 16. A chain passage 63A for travel of the cam chain 62A is formed in the first cylinder block 18A, first cylinder head 19A and first head cover 20A of the first bank 23A and on the opposite side of the crank shaft 16. Furthermore, a chain passage 63B for travel of the cam chain 62B is formed in the second cylinder block 18B, second cylinder head 19B and second head cover 20B of the second bank 23B and on the opposite side of the crank shaft 16.

Figure 8:
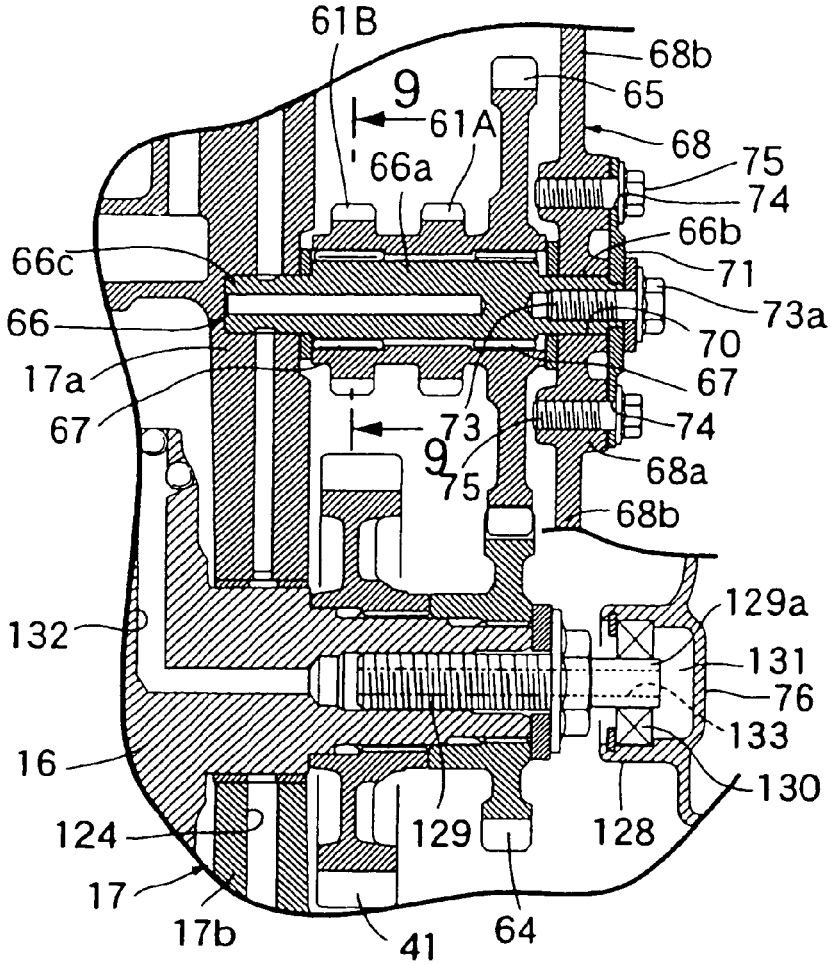
FIG. 8 is an enlarged view of a principal portion of FIG. 2.

Referring also to FIG. 8, an idler driving gear 64 smaller in diameter than the primary driving gear 41 is formed on the opposite end portion of the crank shaft 16 in such a manner that an outer periphery thereof is opposed to the clutch 34 interposed between the crank shaft 16 and the gear transmission 30. An idle gear 65 meshing with the idler driving gear 64 is supported rotatably by an idle shaft 66 having an axis parallel to the crank shaft 16. In addition, the driving sprocket 61A for the first bank and the driving sprocket 61B for the second bank are coaxially provided axially inside the idle gear 65 and contiguously to the idle gear 65 in such a manner that their outer peripheries are opposed at least partially to the primary driving gear 41.

The driving sprocket 61A for the first bank and the driving sprocket 61B for the second bank are integral with the idle gear 65 which is a single gear common to both the driving sprocket 61A for the first bank and the driving sprocket 61B for the second bank. The intake-side and exhaust-side driven sprockets 59A, 60A are fixed respectively to the intake-side and exhaust-side cam shafts 56A, 58A on the first bank 23A side, the driving sprocket 61A for the first bank and the cam chain 62A, which are for driving the cam shafts 56A and 58A. As well as the intake-side and exhaust-side driven sprockets 59B, 60B fixed respectively to the intake-side and exhaust-side cam shafts 56B, 58B on the second bank 23B side, the driving sprocket 61B for the second bank and the cam chain 62B, which are for driving the cam shafts 56B and 58B, are disposed in mutually adjacent manner on the opposite end side in the axial direction of the crank shaft 16.

Figure 9:
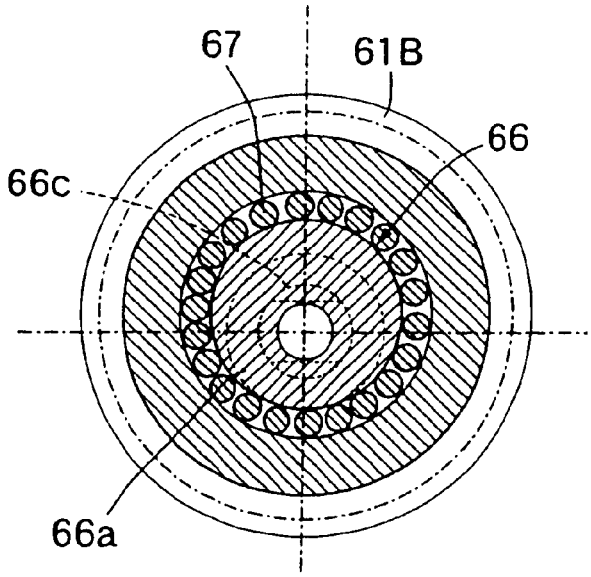
FIG. 9 is an enlarged sectional view taken on line 9-9 in FIG. 8.

Referring to FIG. 9, the idle shaft 66 is integrally provided with an intermediate offset shaft portion 66*a* and support shaft portions 66*b* and 66*c* contiguous to both ends of the offset shaft portion 66*a* and having one and the same axis offset from the axis of the offset shaft portion 66*a*. The idle gear 65, as well as the driving sprocket 61A for the first bank and the driving sprocket 61B for the second bank, are supported rotatably by the offset shaft portion 66*a* through a pair of needle bearings 67.

The idle shaft 66 is supported by the crank case 17 so as to be rotatable about the axes of the support shaft portions 66*b* and 66*c*, i.e., rotatable about an axis offset from the axis of the offset shaft portion 66*a*. The support shaft portion 66*b* on one end side of the idle shaft 66 is supported rotatably by a shaft holder 68 which is clamped to the right support wall of the crank case 17 in a state facing the front side in the motorcycle advancing direction. The support shaft portion 66*c* on the opposite end side of the idle shaft 66 is supported rotatably by the right support wall of the crank case 17.

Figure 10:
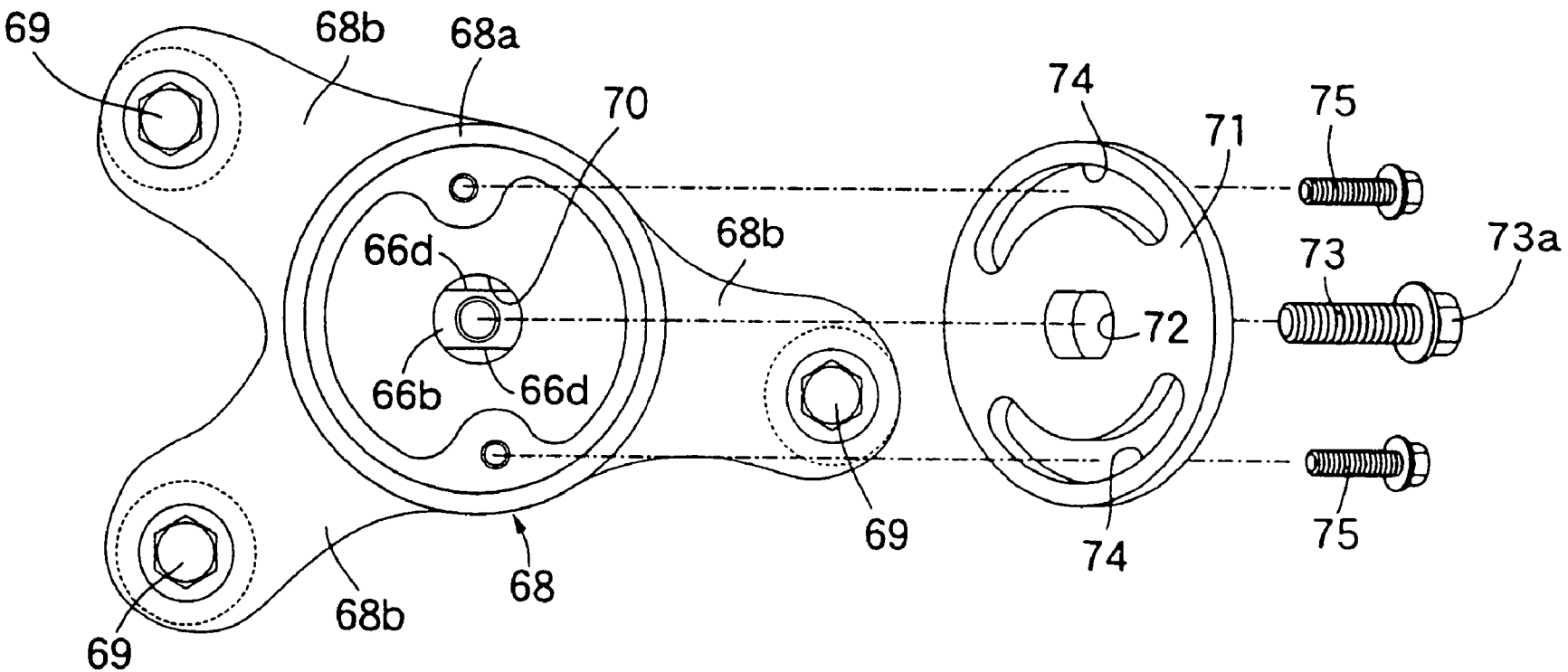
FIG. 10 is an exploded perspective view of a shaft holder and a restriction disc.

Referring to FIG. 10, the shaft holder 68 is integrally provided with a disc-like support portion 68*a* and support arm portions 68*b* projecting sideways outward from plural, say, three, circumferential positions, of the support portion 68*a*. Projecting ends of the support arm portions 68*b* are fixed to the right support wall of the crank case 17 with bolts 69 at positions not obstructing the travel of the cam chains 62A and 62B. A circular support hole 70 is formed centrally of the support portion 68*a* and the support shaft portion 66*b* located on one end side of the idle shaft 66 is fitted and supported in the support hole 70 rotatably. In addition, a front end of the support shaft portion 66*b* located on one end side of the idle shaft 66 is formed in a non-circular cross sectional shape so as to have for example a pair of mutually parallel flat surfaces 66*d* on the outer periphery thereof.

A restriction disc 71 is disposed outside the support portion 68*a* in the shaft holder 68 and a restriction hole 72 for fitting therein the front end of the support shaft portion 66*b* in a relatively unrotatable manner is formed centrally of the restriction disc 71. Furthermore, a bolt 73 is brought into threaded engagement with the support shaft portion 66*b* in such a manner that a head portion 73*a* of a larger diameter is engaged with the restriction disc 71. That is, the restriction disc 71 is fixed to the support shaft portion 66*b*.

A pair of arcuate elongated holes 74 centered on the axis of the support shaft portion 66*b* are formed in the restriction disc 71 in, say, two positions around the restriction hole 72. A pair of bolts 75 is inserted into the elongated holes 74 and is brought into engagement with the support portion 68*a* of the shaft holder 68.

With the bolts 75 tightened, the idle shaft 66 is inhibited from rotating about the axis of the support shaft portions 66*b* and 66*c*, but by loosening the bolts 75 it becomes allowable for the idle shaft 66 to rotate about the axes of the support shaft portions 66*b* and 66*c*, that is, rotate about an axis offset from the axis of the offset shaft portion 66*a*.

A cover 76 which not only covers the clutch 34 but also covers one end portion of the crank shaft 16 and the shaft holder 68 is joined to the right side wall of the crank case 17 contiguously to the cylinder blocks 18A and 18B of the first and second banks 23A, 23B.

Referring to FIG. 6, the driving sprocket 61A for the first bank and the driving sprocket 61B for the second bank are adapted to rotate in direction of arrow 77. On the first bank 23A, the portion corresponding to between the driving sprocket 61A for the first bank and the exhaust-side driven sprocket 60A on the cam chain 62A, i.e., the portion corresponding to the outside of both banks 23A and 23B, is a slack side. Moreover, on the first bank 23A, the portion corresponding to between the intake-side driven sprocket 59A and the driving sprocket 61A for the first bank on the cam chain 62A, i.e., the portion corresponding to the inside of both banks 23A and 23B, is a tension side. On the second bank 23B side, the portion corresponding to between the exhaust-side driving sprocket 60B and the driving sprocket 61B for the second bank on the cam chain 62B, i.e., the portion corresponding to the outside of both banks 23A and 23B, is a slack side. Moreover, on the second bank 23B side the portion corresponding to between the intake-side driven sprocket 59B and the driving sprocket 61B for the second bank on the cam chain 62B, i.e., the portion corresponding to the inside of both banks 23A and 23B, is a tension side.

Attached to the crank case 17 are a chain guide member 80A which is in contact with the tension-side outer periphery of the cam chain 62A on the first bank 23A side, a chain tensioner 81A which is in contact with the slack-side outer periphery of the cam chain 62A on the first bank 23A side, a chain guide member 80B which is in contact with the tension-side outer periphery of the cam chain 62B on the second bank 23B side, and a chain tensioner 811B which is in contact with the slack-side outer periphery of the cam chain 62B on the second bank 23B side.

In the chain guide member 80A on the first bank 23A side, an end portion 204 thereof located on the driving sprocket 61A side for the first bank is formed so as to cover sideways from the outside at least a part of the portion of the outer periphery of the driving sprocket 61A for the first bank on which portion the cam chain 62A is entrained. In this embodiment the end portion 204 is formed so as to lap on the lower side of the driving sprocket 61A for the first bank.

Figure 11:
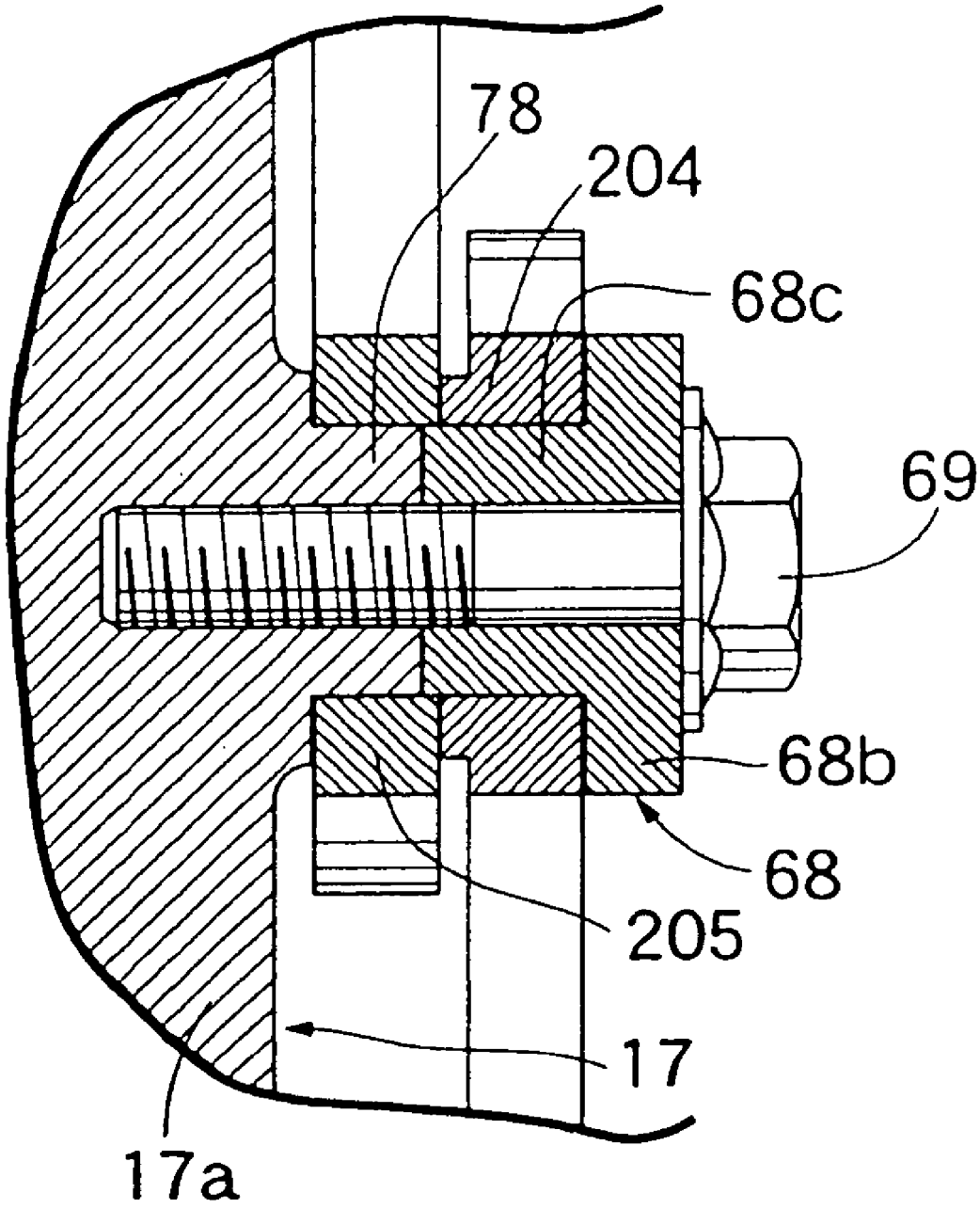
FIG. 11 is an enlarged sectional view taken on line 11-11 in FIG. 1.

Referring also to FIG. 11, the chain guide member 80B on the second bank 23B side is provided with a support portion 205 whose front end is sandwiched in between the front end portion 204 of the chain guide member 80A on the first bank 23A side and the crank case 17. The end portion 204 of the chain guide member 80A and the support portion 205 of the chain guide member 80B are disposed in a mutually superimposed manner at an obliquely lower position in the vicinity of the driving sprockets 61A and 61B for the first and second banks.

Moreover, cylindrical portions 68*c* abutted against cylindrical support bosses 78 projected integrally from the upper case 17*a* of the crank case 17 are integrally projected from the three support arms 68*b* of the shaft holder 68 which supports the idle shaft 66, and bolts 69 are inserted through the cylindrical portions 68*c* and are threadedly engaged with the support bosses 78. By tightening the bolts 69, the shaft holder 68 is fixed to the upper case 17*a* of the crank case 17. One of the support arm portions 68*b* is disposed at a position to sandwich the mutually superimposed end portion 204 and support portion 205 in between it and the crank case 17. The end portion 204 of the chain guide member 80A and the support portion 205 of the chain guide member 80B are supported by the associated cylindrical portion 68*c* and support boss 78.

Upper portions of both chain guide members 80A and 80B are abutted against and supported by the inner walls of the first and second cylinder heads 19A, 19B in both banks 23A and 23B.

The chain tensioner 81A on the first bank 23A side is formed in a bow shape so that a convexly curved surface thereof comes into sliding contact with the slack-side outer periphery of the cam chain 62A at the portion corresponding to the outside of both banks 23A and 23B. Likewise, the chain tensioner 81B on the second bank 23B side is formed in a bow shape so that a convexly curved surface thereof comes into sliding contact with the slack-side outer periphery of the cam chain 62B at the portion corresponding to the inside of both banks 23A and 23B. One end portions on the crank shaft 16 side of the chain tensioners 81A and 81B are supported in the crank case 17 pivotably through pivot shafts 82A and 82B.

For imparting tension to the slack side of the cam chains 62A and 62B, tensioner lifters 83A and 83B come into abutment against the chain tensioners 81A and 81B in the first and second banks 23A, 23B from the side opposite to the cam chains 62A and 62B. The tensioner lifters 83A and 83B are provided respectively in the cylinder heads 19A and 19B of both banks 23A and 23B.

More specifically, the tensioner lifter 83A in the first bank 23A is provided in the first cylinder head 19A at the portion corresponding to the outside of both banks 23A and 23B, while the tensioner lifter 83B in the second bank 23B is provided in the second cylinder head 19B at the portion corresponding to the inside of both banks 23A and 23B.

The tensioner lifter 83A and 83B, which are of a conventional type, are provided with cylindrical cases 84A and 84B and bush rods 85A and 85B projecting from one ends of the cases 84A and 84B and urged in the projecting directions. The cases 84A and 84B are fitted in mounting holes 87A and 87B in such a manner that their tips are put in contact with the outer peripheries of the cam chains 62A and 62B, the mounting holes 87A and 87B being formed in the first and second cylinder heads 19A and 19B, respectively. Flanges 86A and 86B project radially outwards from intermediate positions of the cases 84A and 84B, respectively, and are clamped to the first and second cylinder heads 19A and 19B, respectively.

The distance LA from the upper-end joining surface 22A of the first cylinder head 19 to the tensioner lifter 83A on the first bank 23A side is set shorter than the distance LB from the upper-end joining surface 22B of the second cylinder head 19B to the tensioner lifter 83B on the second bank 23B side.

The projecting portion of the tensioner lifter 83B projecting from the second cylinder head 19B in the second bank 23B is inclined so as to approach the upper-end joining surface 22B of the second cylinder head 19B as it extends outward. The projecting portion of the tensioner lifter 83A projecting from the first cylinder head 19A in the first bank 23A is inclined so as to become more distant from the upper-end joining surface 22A of the first cylinder head 19A as it extends outward.

Referring also to FIGS. 12 to 15, an oil pump 93 as an auxiliary device including a feed pump 91 and a scavenging pump 92 both having a common oil pump shaft 90 is disposed in a lower portion of the transmission chamber 27. A pump housing 94 of the oil pump 93 is mounted from below to the barrier rib 28 provided in the crank case 17.

The pump housing 94 includes a pump body 95 and first and second covers 96, 97 which hold the housing body 95 grippingly from both sides and which are clamped with plural bolts 98. A mounting portion 95*a*, which is integral with the housing body 95 and extends upward, is secured to the barrier rib 28. The oil pump shaft 90 extends rotatably through the pump housing 94. A driven sprocket 99 for the pump is fixed to one end portion of the oil pump shaft 90. Furthermore, an endless chain 101 is entrained on both a driving sprocket 100 for the pump and the driven sprocket 99 for the pump, the driving sprocket 100 being supported by the main shaft 31 outside the crank case 17 so as to rotate together with the primary driven gear 42. Thus, the feed pump 91 and the scavenging pump 92 are driven with power transmitted thereto from the main shaft 31 which is interlocked with the crank shaft 16.

The feed pump 91 and the scavenging pump 92 are trochoid pumps. In the feed pump 91, an inner rotor 102 fixed to the oil pump shaft 90 and an outer rotor 103 meshing with the inner rotor 102 are accommodated between the housing body 95 and the first cover 96. In the scavenging pump 92, an inner rotor 104 fixed to the oil pump shaft 90 and an outer rotor 105 meshing with the inner rotor 104 are accommodated between the housing body 95 and the second cover 97.

A suction passage 106 for the suction of oil into the feed pump 91 is formed in the first cover 96 in the pump housing 94. At least an upstream portion of the suction passage 106 is formed so as to extend vertically and an upstream end of the suction passage 106 is open to a lower end of the first cover 96 so as to open downward.

The feed pump 91 sucks oil present in the interior of the oil pan 25 through an oil strainer 107 disposed within the oil pan 25. The oil strainer 107 is connected to the suction passage 106. A casing 108 of the oil strainer 107 includes a pair of upper and lower members joined together. The casing 108 includes a flat casing body 108*a*, a connecting pipe portion 108*b* extending upward from the casing body 108*a*, and a suction pipe portion 108*c* extending downward from the casing body 108*a* so as to become smaller in diameter downward and provided at a lower end thereof with a suction port 110. A lower portion of the casing 108 is formed in the shape of a funnel.

An upper end of the connecting pipe portion 108*b* is fitted in the upstream end of the suction passage 106 through an annular sealing member 109. An upper end portion of the casing 108 is supported by the first cover 96 of the pump housing 94 which is attached to the barrier rib 28 of the crank case 17. That is, the lower portion of the casing 108 whose upper end portion is supported on the crank case 17 side through the pump housing 94 is formed in the shape of a funnel and the suction port 110 is formed in the lower end of the casing 108.

Figure 13:
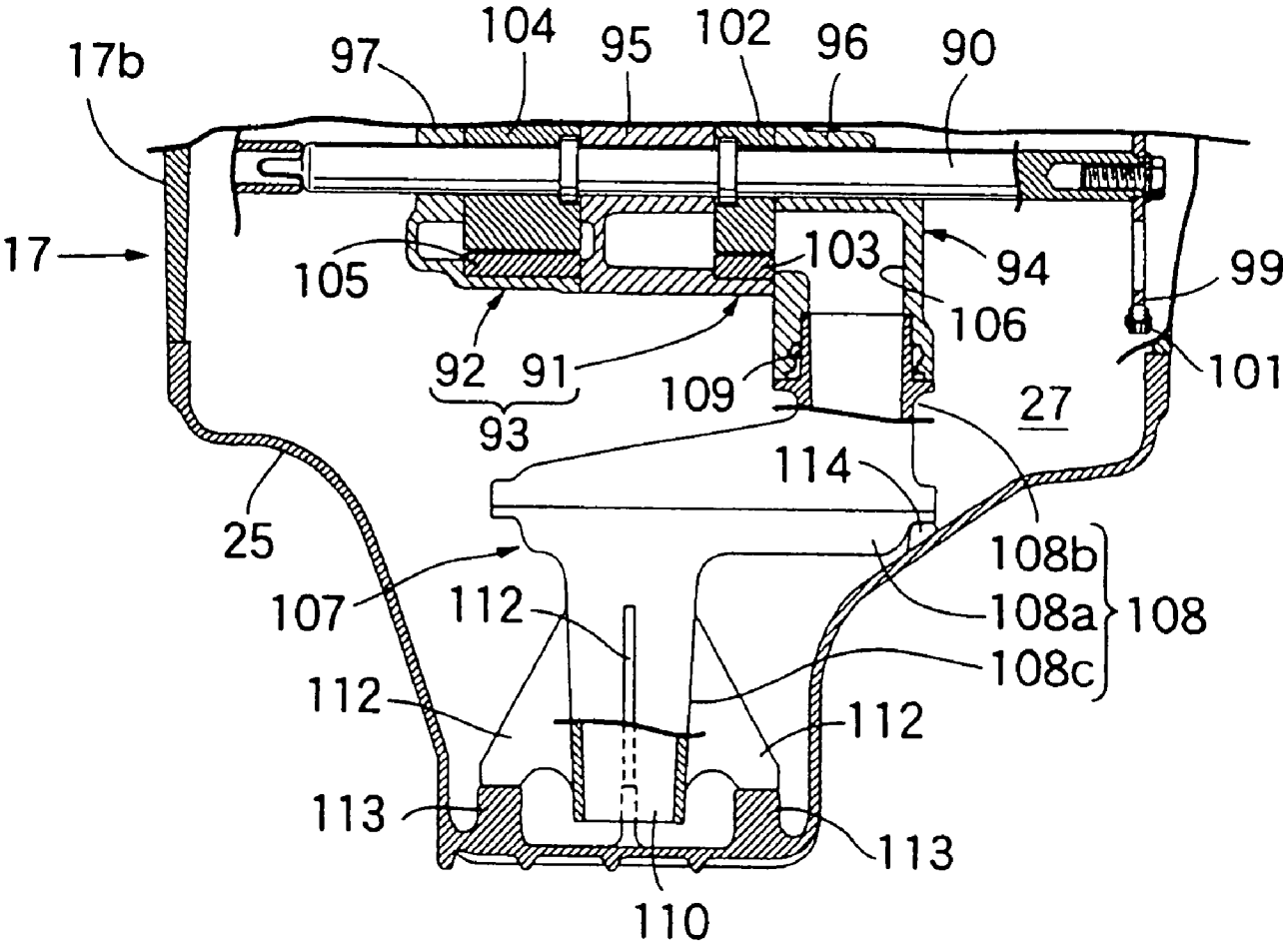
FIG. 13 is an enlarged sectional view taken on line 13-13 in FIG. 1.

As shown in FIG. 13, the oil pan 25 is formed in a generally V shape whose lower portion is narrow when looking from the rear side in the motorcycle advancing direction. In the casing 108 of the oil strainer 107, the casing body 108*a* and the connecting pipe portion 108*b* are positioned close to the right support wall of the oil pan 25 when looking from the rear side in the motorcycle advancing direction, and the suction pipe portion 108*c* is disposed nearly centrally in the transverse direction of the oil pan 25.

Plural, say, four, strainer support portions 112 are integrally formed on a side face of the suction pipe portion 108*c* in the lower portion of the casing 108. The strainer support portions 112 are formed in a vertically long slope shape so as to become larger in projection quantity from the casing 108 toward the bottom of the oil pan 25. The strainer support portions 112 are abutted against and supported by support projections 113 projected from the bottom of the oil pan 25.

The strainer support portions 112 are disposed right and left of the suction pipe portion 108*c* perpendicularly to the motorcycle advancing direction and are positioned before and behind the suction pipe portion 108*c*.

A support projection 114 abutted against a lower portion on the right side of the casing body 108*a* in the casing 108 is integrally projected from the right side wall of the oil pan 25.

Figure 14:
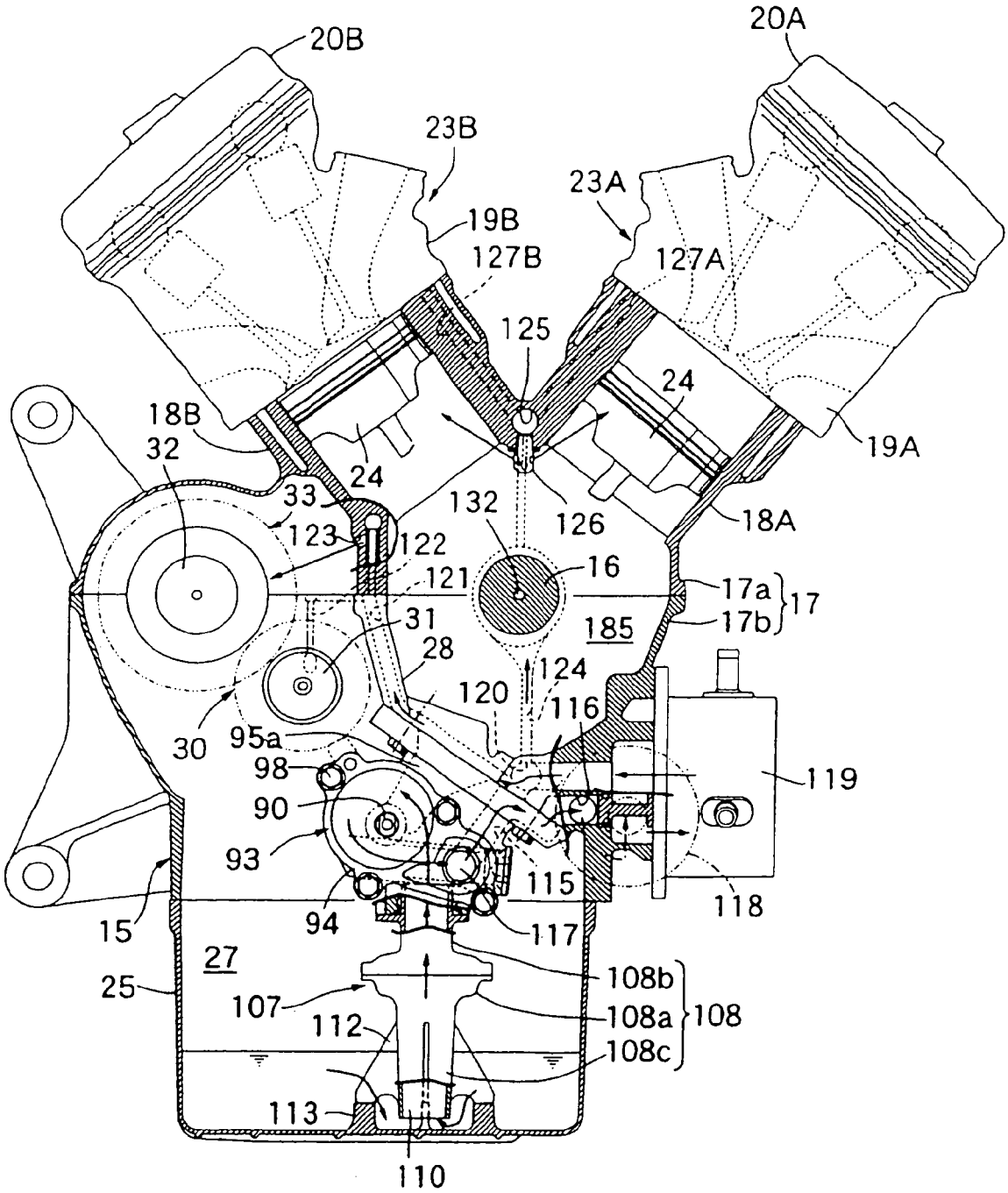
FIG. 14 is a vertical sectional view of an engine body as seen in the same direction as in FIG. 1, showing a flow of oil by a feed pump.
Figure 15:
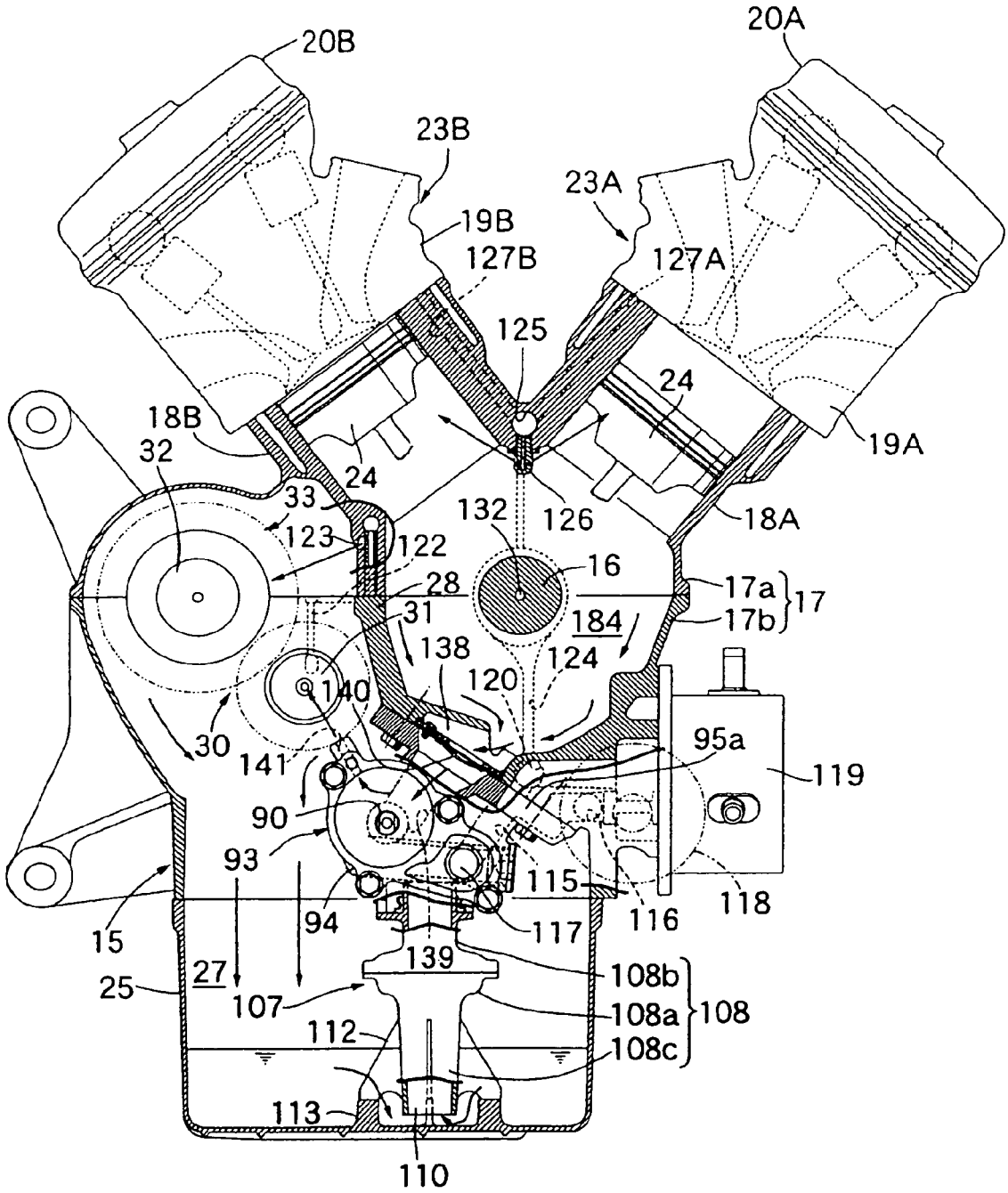
FIG. 15 is a vertical sectional view of the engine body corresponding to FIG. 14, showing a flow of oil by a scavenging pump.

Referring to FIGS. 14 and 15, a discharge passage 115 for the discharge of oil from the feed pump 91 is formed in the housing body 95 of the pump housing 94. The discharge passage 115 is put in communication with an oil passage 116 formed in the barrier rib 28 of the crank case 17. Moreover, a relief valve 117 having an axis parallel to the oil pump shaft 90 is disposed between the casing body 95 of the pump housing 94 and the first cover 96 so as to become open when the discharge pressure of the discharge passage 115 has become a predetermined value or higher, allowing a portion of the oil flowing through the discharge passage 115 to escape to the suction side of the feed pump 91.

As indicated with arrows in FIG. 14, the oil flowing through the oil passage 116 formed in the barrier rib 28 passes through an oil filter 118 attached to the crank case 17 and is purified thereby, then is introduced into an oil cooler 119 attached to the crank case 17 and is cooled thereby.

A main gallery 120 extending in parallel with the crank shaft 16 is provided in the barrier rib 28 and the oil introduced into the main gallery 120 from the oil cooler 119 is branched into two. One oil portion is conducted to an oil passage 121 formed in the barrier rib 28, then passes through an oil passage 122 and is fed to the shaft support portions of the first to sixth shift gear trains G1 to G6 for the main shaft 31 and the counter shaft 32 in the gear transmission 30. Further, the oil is jetted toward the gear transmission 30 from a nozzle 123 which is provided in the crank case 17 so as to face the upper portion of the transmission 27.

The other oil portion branched from the main gallery 120 is fed upward from plural oil passages 124 formed in the crank case 17 and is used for lubrication of plural bearing portions which support the crank shaft 16. The oil passages 124 are in communication with an upper oil gallery 125 which is provided in an upper portion of the crank case 17 so as to extend in parallel with the crank shaft 16 at the joined portion between both banks 23A and 23B. The oil is jetted toward the pistons 24 in the cylinders in both banks 23A and 23B from nozzles 126 connected to the oil gallery 125. Oil passages 127A and 127B for conducting oil from the upper oil gallery 125 to a valve operating mechanism disposed between the cylinder heads 19A, 19B and the head covers 20A, 20B are formed in the cylinder blocks 18A, 18B and the cylinder heads 19A, 19B in the first and second banks 23A, 23B.

As shown clearly in FIG. 8, a cylindrical portion 128 projecting to the crank shaft 16 side is integrally provided on an inner surface of the right cover 76 at the portion corresponding to the opposite end portion of the crank shaft 16, and a bolt 129 having a rounded portion 129*a* projecting into the cylindrical portion 128 is threadedly engaged coaxially with one end portion of the crank shaft 16. Further, an annular sealing member 130 is interposed between the cylindrical portions 128 and the rounded portion 129*a*. An oil chamber 131 sealed with the annular sealing member 130 is formed within the cylindrical portion 128 in such a manner that an end portion of the rounded portion 129*a* faces the oil chamber. Oil from the main gallery 120 is fed to the oil chamber 131 through an oil passage (not shown).

Moreover, a communication passage 133 is coaxially formed in the bolt 129 to provide communication of an internal oil passage 132 formed in the interior of the crank shaft 16 with the oil chamber 131. The oil introduced into the internal oil passage 132 is used for lubrication between large end portions of the crank pins 16*a* and the connecting rods 29 provided on the crank shaft 16.

Referring to FIG. 15, an oil collection hole 138 for the collection of oil dropped to a lower portion in the interior of the crank chamber 26 is formed in a lower portion of the barrier rib 28 so as to communicate with lower portions of the first to third crank chambers 183, 184 and 185. On the other hand, a suction passage 139 for the suction of oil into the scavenging pump 92 is formed in the housing body 95 correspondingly to the oil collection hole 138, the housing body 95 being integrally provided with the mounting portion 95*a* which is secured to the barrier rib 28 in the pump housing 94.

Moreover, a reed valve 140 which permits only the flow of oil from the oil collection hole 138 to the suction passage 139 is disposed between the oil collection hole 138 communicating with the second crank chamber 184 which corresponds to the central cylinder in the arranged direction of cylinders in the first bank 23A and the suction passage 139 formed in the housing body 95.

A discharge passage 141 for the oil discharged from the scavenging pump 92 is formed in the second cover 96 in the pump housing 94. The discharge passage 141 is formed in the second cover 96 so as to discharge oil from a downstream end thereof toward the gear transmission 30.

Figure 12:
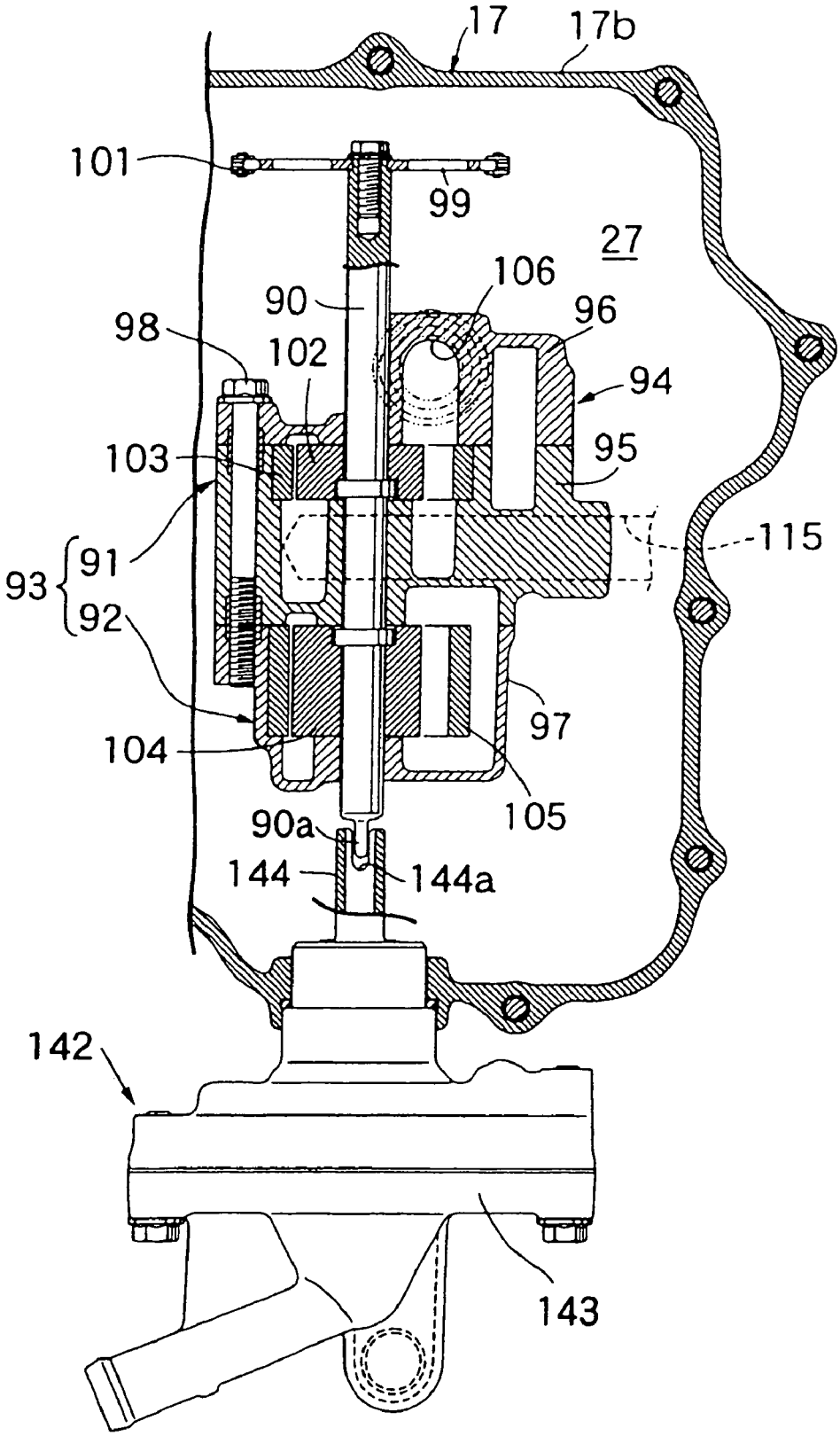
FIG. 12 is an enlarged sectional view taken on line 12-12 in FIG. 1.

Referring to FIG. 12, a pump case 143 of the water pump 142 is attached to the left support wall of the crank case 17 at the portion corresponding to the oil pump 93. A water pump shaft 144 of the water pump 142 is disposed coaxially with the oil pump shaft 90 of the oil pump 93 in such a manner that one end thereof projects from the pump case 143. Besides, a projection 90*a* projected from the opposite end of the oil pump shaft 90 is engaged disengageably with an engaging recess 144*a* formed in one end of the water pump shaft 144. That is, the feed pump 91 and the scavenging pump 92 in the oil pump 93 are actuated with power transmitted thereto from the main shaft 31. The water pump 142 is also actuated with the power transmitted from the main shaft 31.

As shown in FIG. 1, the oil pump 93 is disposed between a vertical plane P1 passing through the axis of the crank shaft 16 and a vertical plane P2 passing through the axis of the main shaft 31, and a shift drum 39 as an auxiliary device is disposed on the side opposite to the oil pump 93 with respect to the vertical plane P2 so as to constitute a part of the gear transmission 30. The oil pump 93 and the shift drum 39 are disposed around the main shaft 31.

The following description is now provided about the operation of this embodiment. The intake-side and exhaust-side driven sprockets 59A, 60A are mounted on the intake-side and exhaust-side cam shafts 56A, 58A which are for opening and closing the intake valves 51A and exhaust valves 52A in the first bank 23A. The endless cam chain 62A is entrained on the driving sprocket 61A for the first bank adapted to rotate together with the idle gear 65 to which the power from the crank shaft 16 is transmitted and is also entrained on the intake- and exhaust-side cam shafts 56A, 58A. The intake-side and exhaust-side driven sprockets 59B, 60B are mounted on the intake-side and exhaust-side cam shafts 56B, 58B which are for opening and closing the intake valves 51B and exhaust valves 52B in the second bank 23B. Furthermore, the endless cam chain 62B is entrained on the driving sprocket 61B for the second bank which sprocket is adapted to rotate together with the idle gear 65 and is also entrained on the intake- and exhaust-side cam shafts 56B, 58B. On the crank shaft 16 are mounted the primary driving gear 41 which transmits the engine power to the gear transmission 30 and the idler driving gear 64 which is formed smaller in diameter than the primary driving gear 41 and which is disposed axially outward with respect to the primary driving gear 42. The idle gear 65 meshing with the idler driving gear 64 is supported rotatably on the idle shaft 66 which has an axis parallel to the crank shaft 16 and which is supported by the crank case 17 of the engine body 15. The driving sprockets 61A and 61B for the first and second banks are coaxially contiguous to the idle gear 65 on the axially inner side of the idle gear in such a manner that at least a part of its outer periphery is opposed to the primary driving gear 41.

That is, the idle gear 65 is brought into mesh with the idler driving gear 64 which is smaller in diameter than the primary driving gear 41 of a relatively large diameter which is mounted on the crank shaft 16. Further, the driving sprockets 61A and 61B for the first and second banks are coaxially contiguous to the idle gear 65 on the axially inner side of the idle gear 65 so that their outer peripheries are opposed at least partially to the primary driving gear 64. Consequently, it is possible to shorten the distance between the crank shaft 16 and the idle shaft 66 and make contribution to the reduction in size of the V-type engine.

Moreover, since the primary driven gear 42 engaged with the primary driving gear 41 is disposed at a position opposed to the outer periphery of idler driving gear 64 and is connected to the clutch 34 which is disposed between the crank shaft 16 and the gear transmission 30, the crank shaft 16 and the clutch 34 can be disposed in proximity to the crank shaft 16 and it is possible to shorten the center distance between the axis of the clutch 34 and the crank shaft 16 and make a further contribution to the reduction in size of the V-type engine.

The driving sprocket 61A for the first bank on the first bank 23A side, the driven sprocket 59A on the intake side, the exhaust-side driven sprocket 60A and the cam chain 62A, as well as the driving sprocket 61B for the second bank on the second bank 23B side which forms V shape together with the first bank 23A, the intake-side driven sprocket 59B, the exhaust-side driven sprocket 60B and the cam chain 62*b*, are disposed in a mutually adjacent manner on one axial end side of the crank shaft 16. The driving sprockets 61A and 61B for the first and second banks are formed integrally with the idle gear 65 which is a single gear common to both the driving sprockets 61A and 61B for the first and second banks. Therefore, it is possible to make contribution to the reduction in size of the V-type engine in the axial direction of the crank shaft 16 and attain the reduction in the number of engine parts.

The idle shaft 66 having the offset shaft portion 66*a* is supported by the crank case 17 so that its position about an axis offset from the axis of the offset shaft portion 66*a* can be adjusted, and the idle gear 65 is supported rotatably by the offset shaft portion 66*a* through the needle bearings 67. Therefore, while the backlash between the idler driving gear 64 and the idle gear 65 can be diminished by adjusting the rotational axis of the idle gear 65, it is possible to prevent an increase in size of the driving sprockets 61A and 61B for the first and second banks and the idle gear 65 and further shorten the center distance between the idle shaft 66 and the crank shaft 16.

In the first and second banks 23A, 23B, the tensioner lifters 83A and 83B are brought into abutment against the chain tensioners 81A and 81B which are put in sliding contact with the cam chains 62A and 62B, the abutment of the tensioner lifters 83A and 83B against the chain tensioners 81A and 81B being performed from the side opposite to the cam chains 62A and 62B while imparting tension to the cam chains 62A and 62B. The tensioner lifters 83A and 83B are provided in the first and second cylinder heads 19A and 19B in the first and second banks 23A, 23B. One of both tensioner lifters 83A and 83B, which in this embodiment is the tensioner lifter 83A in the first bank 23A located on the front side in the motorcycle traveling direction, is provided in the first cylinder head 19A at the portion corresponding to the outside of both banks 23A and 23B. The other tensioner lifter 23B is provided in the second cylinder head 19B at the portion corresponding to the inside of both banks 23A and 23B. Further, the distance LA from the upper-end joining surface 22A of the first cylinder head 19A up to one tensioner 83A is set smaller than the distance LB from the upper-end joining surface 22B of the second cylinder head 19B up to the other tensioner lifter 83B.

Therefore, the tensioner lifter 83B provided in the second cylinder head 19B at the portion corresponding to the inside of both banks 23A and 23B can be disposed at as lower a position as possible, whereby it is possible to minimize the dead space between both banks 23A and 23B.

Since the projecting portion of the other tensioner lifter 83B projecting from the second cylinder head 19B is disposed inclinedly so as to approach the upper-end joining surface 22B of the second cylinder head 19B, not only it is possible to further diminish the dead space between both banks 23A and 23B, but also it is possible to facilitate mounting of the tensioner lifter 83B to the second cylinder head 19B from above and improve the mounting performance.

Furthermore, since the projecting portion of one tensioner lifter 83A projecting from the first cylinder head 19A is disposed inclinedly away from the upper-end joining surface 22A of the first cylinder head 19A, not only it is possible suppress projection of the tensioner lifter 83A from the first cylinder head 19A which tensioner lifter is disposed outside both banks 23A and 23B and thereby make contribution to the reduction in size of the engine, but also it is possible to ensure a mounting space of auxiliary devices disposed around the engine.

In the power transfer section 50A on the first bank 23A side, the end portion 204 of the chain guide member 80A on the driving sprocket 61A side for the first bank is formed so as to cover sideways from the outside at least a part of the cam chain 62A-entrained portion of the outer periphery of the driving sprocket 61A for the first bank. Therefore, it is possible to prevent the occurrence of fluttering of the cam chain 62A at the portion of the driving sprocket 61A for the first bank where the chain is entrained onto the driving sprocket 61A for the first bank and thus the cam chain 62A can be guided stably by the chain guide 80A. Besides, the end portion 204 of the chain guide 80A can retain the entrained state of the cam chain 62A onto the driving sprocket 61A for the first bank lest the cam chain 62A should fall off from the driving sprocket 61A for the first bank during the mounting work. Thus, it is possible to improve the mounting performance.

The chain guide member 80A in the power transfer section 50A of the first bank 23A as one of the first and second banks 23A, 23B which form a V shape is constructed as above. Therefore, even in a V-type engine wherein fluttering of the cam chains 62A and 62B is apt to occur due to the cam chains 62A and 62B being entrained on the driving sprockets 61A and 61B for the first and second banks which sprockets are coaxially disposed correspondingly to the first and second banks 23A, 23B, it is possible to prevent the occurrence of fluttering of the cam chain 62A in at least the chain-entrained portion onto the driving sprocket 61A for the first bank. Thus, it is possible to improve the mounting performance.

Since the end portion 204 of the chain guide member 80A located on the driving sprocket 61A side for the first bank is formed so as to lap on the lower side of the driving sprocket 61A for the first bank, the cam chain 62A can be covered with the end portion 204 of the chain guide member 80A over a wider range at the chain-entrained portion of the driving sprocket 61A for the first bank. Besides, since the end portion 204 of the chain guide member 80A is supported by both the support boss 78 which is provided in the crank case 17 of the engine body 15 in the vicinity of the driving sprocket 61A for the first bank and the cylindrical portion 68*c* of the shaft holder 68 which is clamped to the support boss 78 with bolt 69, it is possible to suppress the occurrence of fluttering of the cam chain 62A more effectively at the chain-entrained portion onto the driving sprocket 61A for the first bank.

In the power transfer section 50A on the first bank 23A side, the end portion 204 of the chain guide member 80A is formed so as to straddle the cam chain 62B in the power transfer section 50B of the second bank 23B and so as to lap on the lower side of the driving sprocket 61A for the first bank. Therefore, also in the V-type engine, it is possible to prevent the occurrence of fluttering of the cam chain 62A more effectively at the chain-entrained portion onto the driving sprocket 61A for the first bank.

Moreover, since the end portion 204 of the chain guide member 80A in the power transfer section 50A on the first bank 23A side and the support portion 205 provided in the chain guide member 80B in the power transfer section 50B on the second bank 23B side are superimposed one on the other and are supported by the support boss 78 and the cylindrical portion 68*c* of the shaft holder 68, not only it becomes possible to decrease the number of parts, but also the mounting and removal of the chain guides 80A and 80B in both banks 23A and 23B become easier during assembly and disassembly in maintenance, etc., whereby it is possible to attain the saving of time and labor.

Further, the driving sprockets 61A and 61B for the first and second banks are mounted on the idle gear 65 which has an axis parallel to the crank shaft 16 and which is adapted to rotate in interlock with the crank shaft 16. Therefore, by disposing the idle gear 65 in a place having a space margin, the shape of the chain guide members 80A and 80B can be set freely without being influenced by layout. Besides, in comparison with the case where driving sprockets are mounted on the crank shaft 16, it is possible to attain the reduction in size of the driving sprockets 61A and 61B for the first and second banks. The chain-entrained portion of the cam chain 62A onto the driving sprocket 61A for the first bank can be covered over a wider range while avoiding an increase in size of the end portion of the chain guide member 80A on the driving sprocket 61A side for the first bank.

The oil pan 25 for the storage of oil to be fed to various portions of the engine body 15 is provided in the lower portion of the crank case 17. The upper end portion of the casing 108 of the oil strainer 107 is supported on the crank case 17 side and the suction port 110 is formed in the lower end of the casing 108 whose lower portion is formed in a funnel shape. Plural vertically long plate-like strainer support portions 112 are integrally formed on the lower side face of the casing 108 of the oil strainer 107 and are each abutted against and supported by the bottom of the oil pan 25.

Therefore, each strainer support portion 112 is allowed to fulfill the function of a reinforcing rib, whereby it becomes possible to enhance the strength of the lower portion of the casing 108. Besides, it is not necessary to specially enhance the support strength of the crank case 17 side which supports the upper end portion of the oil strainer 107 and it is possible to enhance the support strength of the oil strainer 107. Thus, the oil strainer 107 can be supported strongly while avoiding an increase of weight and an increase in the number of parts used. Moreover, each strainer support portion 112 also fulfills the function of a barrier rib which inhibits the movement of oil within the oil pan 25, so that, within the oil pan 25, it is not necessary to dispose a barrier rib in any other portion than the oil strainer 107, whereby it is also possible to reduce the number of parts used.

Since each strainer support portion 112 is formed so that the amount of its projection from the casing 108 becomes larger toward the lower side, it is possible to effectively uniform the flow of oil in the vicinity of the suction port 110 and hence possible to keep low the suction resistance of oil to the suction port 110 and improve the suction efficiency.

Since the strainer support portions 112 are disposed in a pair in each of longitudinal and transverse directions of the motorcycle, the movement of oil within the oil pan 25 upon sudden acceleration or deceleration of the motorcycle and the movement of oil within the oil pan 25 with a transverse motion of the motorcycle can be inhibited effectively by the strainer support portions 112.

Furthermore, since the oil pan 25 is formed in a generally V shape having a narrow lower portion when looking in the motorcycle advancing direction, a longitudinal movement of oil upon sudden acceleration or deceleration of the motorcycle can be prevented effectively between the right and left side walls of the generally V-shaped oil pan 25 with a narrow lower portion and the oil strainer 107.

The crank shaft 16 and the counter shaft 32 having parallel axes are supported rotatably between the joining surfaces of the upper case 17*a* and the lower case 17*b* which are joined together to constitute the crank case 17 of the engine body 15, and the main shaft 31 with plural shift ranges, say, six shift ranges, of gear trains G1 to G6 capable of being engaged in an alternative manner and interposed between the main shaft and the counter shaft 32 is supported rotatably by the left and right support walls 187, 188 which are provided in the lower case 17*b* spacedly along the axis of the main shaft 31.

The first bearing hole 198 for fitting therein and holding of the needle bearing 197 mounted on one end of the main shaft 31 is formed in the left support wall 187, while in the right support wall 188 is formed the second bearing hole 199 which permits insertion therein of the main shaft 31 from the opposite end side of the main shaft until one end of the main shaft is fitted in the needle bearing 197 which is fitted and held in the first bearing hole 198. The ball bearing 200 is fitted and held in the second bearing hole 199 so as to be fitted on the main shaft 31 from the opposite end side of the main shaft 31 after one end of the main shaft 31 has been fitted in the needle bearing 197.

Therefore, the second bearing hole 199 can be made larger in diameter than the main gear of the largest diameter out of the plural main gears 191 to 196 mounted on the main shaft 31 and can be made smaller in diameter than the through hole heretofore formed in the right support wall 188, whereby the center distance between the crank shaft 16 and the main shaft 31 can be shortened and it is possible to reduce the engine size in the longitudinal direction of the motorcycle. In the conventional structure it is necessary to use a bearing holder which supports an intermediate portion of the main shaft 31 so as to close the through hole, but the bearing holder is not needed in this embodiment. Consequently, the number of parts used can be decreased because the bearing holder is not needed. Besides, the number of assembling steps can be reduced because the mounting of the bearing holder is not needed.

The shift drum 39 and the oil pump 93 are disposed around the main shaft 31, so that the distance from the shift drum 39 and the oil pump 93 to the main shaft 31 can be shortened and it is thereby possible to further reduce the size of the engine.

Moreover, since the oil pump 93 is disposed between the vertical planes P1 and P2 passing through the axes of the crank shaft 16 and the main shaft 31 in such a manner as to operate in interlock with the main shaft 31, the oil pump 93 can be disposed by utilizing the space created between the crank shaft 16 and the main shaft 31. Besides, the oil pump 93 is disposed in proximity to the main shaft 31 which actuates the oil pump 93, and power transfer mechanism for the transfer of power between the main shaft 31 and the oil pump 93 can be made compact by using, for example, the driving sprocket 100 for pump, the driven sprocket 99 for pump and the chain 101.

Furthermore, the upper case 17*a* of the crank case 17 has the ceiling wall portion 179 which covers the counter shaft 32 from above, and since the ceiling wall portion 179 is contiguous to the cylinder block 18B at an intermediate portion in the sliding direction of the piston 24 to the cylinder block 18B in the second bank 23B, the counter shaft 32 can be disposed in proximity to the cylinder block 18B in the second bank 23B, whereby the engine size can be made still smaller in the longitudinal direction of the motorcycle.

Although an embodiment of the present invention has been described above, the present invention is not limited to the above embodiment, but various design changes may be made without departing from the present invention described in the scope of claims.

For example, according to the construction of the above embodiment, power is transmitted from the main shaft 31 through the chain 101 to the oil pump shaft 90 of the oil pump 93, but there may be adopted a construction wherein power is transmitted directly from the crank shaft 16 to the oil pump shaft 90.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An engine for a motorcycle, comprising:

a crank case, said crank case including an upper case and a lower case joined to each other;

a crank shaft and a counter shaft parallel to the crank shaft, said crank shaft and said counter shaft being supported rotatably by the crank case;

a main shaft having an axis parallel to the crank shaft and the counter shaft, said main shaft being supported rotatably by first and second bearings in first and second support walls, respectively, the first and second support walls being provided in the lower case spaced along the axis of the main shaft; and a first bearing hole for fitting therein and holding the first bearing is formed in the first support wall, the first bearing being mounted on a first end of the main shaft, a second bearing hole is formed in the second support wall, the second bearing hole permitting the main shaft to be inserted therein from a second end of the main shaft opposite the first end of the main shaft until the first end of the main shaft is fitted in the first bearing, and a second bearing is fitted and held in the second bearing hole so as to be fitted on the main shaft from the second end of the main shaft after the first end of the main shaft is fitted in the first bearing, wherein a first bank and a second bank are provided contiguously to the upper case of the crank case so as to mutually form a V shape, the second bank being disposed rearwardly of the first bank when in a mounted state on the motorcycle, and a ceiling wall portion of the upper case that covers the counter shaft from above is provided contiguously to a rear portion of a cylinder block of the second bank at an approximately intermediate portion of a slide range of a piston into a cylinder block of the second bank.

2. The engine for a motorcycle according to claim 1, wherein auxiliary devices are disposed around the main shaft.

3. An engine for a motorcycle, comprising:

a crank case, said crank case including an upper case and a lower case joined to each other;

a crank shaft and a counter shaft parallel to the crank shaft, said crank shaft and said counter shaft being supported rotatably by the crank case;

a main shaft having an axis parallel to the crank shaft and the counter shaft, said main shaft being supported rotatably by first and second bearings in first and second support walls, respectively, the first and second support walls being provided in the lower case spaced along the axis of the main shaft;

a first bearing hole for fitting therein and holding the first bearing is formed in the first support wall, the first bearing being mounted on a first end of the main shaft, a second bearing hole is formed in the second support wall, the second bearing hole permitting the main shaft to be inserted therein from a second end of the main shaft opposite the first end of the main shaft until the first end of the main shaft is fitted in the first bearing, and a second bearing is fitted and held in the second bearing hole so as to be fitted on the main shaft from the second end of the main shaft after the first end of the main shaft is fitted in the first bearing; and auxiliary devices are disposed around the main shaft, wherein an oil pump, as one of said auxiliary devices, is disposed between vertical planes passing respectively through the axes of the crank shaft and the main shaft so that the oil pump operates in an interlocked manner with the crank shaft or the main shaft.

4. An engine for a motorcycle, comprising:

a crank case, said crank case including an upper case and a lower case joined to each other;

a crank shaft and a counter shaft parallel to the crank shaft, said crank shaft and said counter shaft being supported rotatably by the crank case;

a main shaft having an axis parallel to the crank shaft and the counter shaft, said main shaft being supported rotatably by first and second bearings in first and second support walls, respectively, the first and second support walls being provided in the lower case spaced along the axis of the main shaft; and a first bearing hole for fitting therein and holding the first bearing is formed in the first support wall, the first bearing being mounted on a first end of the main shaft, a second bearing hole is formed in the second support wall, the second bearing hole permitting the main shaft to be inserted therein from a second end of the main shaft opposite the first end of the main shaft until the first end of the main shaft is fitted in the first bearing, and a second bearing is fitted and held in the second bearing hole so as to be fitted on the main shaft from the second end of the main shaft after the first end of the main shaft is fitted in the first bearing, wherein an inside diameter of the second bearing hole is smaller than an outer diameter of at least one shift gear on the main shaft and is larger than an outside diameter of at least one other shift gear on the main shaft.

5. The engine for a motorcycle according to claim 4, wherein the first bearing hole is formed on an inner surface of the first support wall, said first bearing hole having a bottom that receives an end face of the first bearing and an end face of the first end of the main shaft.

6. The engine for a motorcycle according to claim 4, wherein the second bearing is located on an intermediate portion of the main shaft, the main shaft extending through and past the second support wall and supporting a clutch thereon at the second end, the clutch transferring power from the crank shaft to the main shaft.

7. The engine for a motorcycle according to claim 6, wherein the second support wall includes a projection that extends inward from an inner end of the second bearing hole toward a center of the second bearing hole, said second bearing being supported within said second bearing hole and sandwiched between said projection and a support plate attached to an outer end of the second bearing hole.

8. The engine for a motorcycle according to claim 4, wherein the crank shaft and counter shaft are rotatably supported between joining surfaces of the upper and lower cases.

9. An engine for a motorcycle, comprising:

a crank case, said crank case including an upper case and a lower case joined to each other;

a crank shaft and a counter shaft parallel to the crank shaft, said crank shaft and said counter shaft being supported rotatably by the crank case;

a main shaft having an axis parallel to the crank shaft and the counter shaft, said main shaft being supported rotatably by first and second bearings in first and second support walls, respectively, the first and second support walls being provided in the lower case spaced along the axis of the main shaft; and wherein a first bearing hole for fitting therein and holding the first bearing is formed in the first support wall, the first bearing being mounted on a first end of the main shaft, a second bearing hole is formed in the second support wall, the second bearing hole permitting the main shaft to be inserted therein from a second end of the main shaft opposite the first end of the main shaft until the first end of the main shaft is fitted in the first bearing, and a second bearing is fitted and held in the second bearing hole so as to be fitted on the main shaft from the second end of the main shaft after the first end of the main shaft is fitted in the first bearing, wherein the second support wall includes a projection that extends inward from an inner end of the second bearing hole toward a center of the second bearing hole, said second bearing being supported within said second bearing hole and sandwiched between said projection and a support plate attached to an outer end of the second bearing hole.

* * * * *